US008376067B2

(12) United States Patent
Downton et al.

(10) Patent No.: US 8,376,067 B2
(45) Date of Patent: Feb. 19, 2013

(54) SYSTEM AND METHOD EMPLOYING A ROTATIONAL VALVE TO CONTROL STEERING IN A ROTARY STEERABLE SYSTEM

(75) Inventors: Geoffrey C. Downton, Minchinhampton (GB); Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/977,239

(22) Filed: Dec. 23, 2010

(65) Prior Publication Data

US 2012/0160564 A1 Jun. 28, 2012

(51) Int. Cl.
*E21B 7/04* (2006.01)

(52) U.S. Cl. ..... 175/61; 175/73

(58) Field of Classification Search ..... 166/250.1; 175/61, 73, 325.5, 51
See application file for complete search history.

(56) References Cited

U.S. PATENT DOCUMENTS

| | | | | |
|---|---|---|---|---|
| 3,593,810 | A * | 7/1971 | Fields | 175/61 |
| 4,637,479 | A * | 1/1987 | Leising | 175/26 |
| 5,511,627 | A * | 4/1996 | Anderson | 175/73 |
| 5,603,385 | A * | 2/1997 | Colebrook | 175/45 |
| 5,603,386 | A * | 2/1997 | Webster | 175/76 |
| 5,673,763 | A * | 10/1997 | Thorp | 175/73 |
| 5,706,905 | A * | 1/1998 | Barr | 175/61 |
| 6,089,332 | A * | 7/2000 | Barr et al. | 175/45 |
| 6,116,354 | A * | 9/2000 | Buytaert | 175/55 |
| 6,209,664 | B1 * | 4/2001 | Amaudric du Chaffaut | 175/61 |
| 6,962,214 | B2 * | 11/2005 | Hughes et al. | 175/107 |
| 7,195,225 | B1 * | 3/2007 | Holliday | 251/63.5 |
| 7,926,592 | B2 * | 4/2011 | Smith et al. | 175/81 |
| 7,942,213 | B2 * | 5/2011 | Sihler | 175/61 |
| 2002/0179336 | A1 * | 12/2002 | Schaaf et al. | 175/61 |
| 2006/0090935 | A1 * | 5/2006 | Van Steenwyk et al. | 175/73 |
| 2006/0249287 | A1 * | 11/2006 | Downton et al. | 166/250.1 |
| 2007/0221409 | A1 | 9/2007 | Hall et al. | |
| 2008/0110674 | A1 * | 5/2008 | Jones et al. | 175/25 |
| 2009/0166086 | A1 * | 7/2009 | Sugiura | 175/25 |
| 2010/0071962 | A1 | 3/2010 | Benershausen | |
| 2011/0036632 | A1 * | 2/2011 | Polynstev | 175/61 |

OTHER PUBLICATIONS

Seach report from the equivalent GB patent application No. of 1121960.7 issued on Mar. 12, 2012.

* cited by examiner

*Primary Examiner* — Giovanna Wright
*Assistant Examiner* — Michael Wills, III
(74) *Attorney, Agent, or Firm* — Chadwick A. Sullivan

(57) ABSTRACT

A system and methodology provide improved control over the directional drilling of a wellbore. A rotational valve is mounted within a drill collar of a rotary steerable system to control flow of actuating fluid to one or more steering pads which are selectively moved in a lateral direction with respect to the rotary steerable system. The rotational valve is designed to provide enhanced control over the flow of actuating fluid to the steering pads to facilitate drilling of straight sections of wellbore and deviated or non-linear sections wellbore.

20 Claims, 22 Drawing Sheets

SYSTEM AND METHOD EMPLOYING A ROTATIONAL VALVE TO CONTROL STEERING IN A ROTARY STEERABLE SYSTEM

BACKGROUND

A variety of valves are used to control flow of actuating fluids in many well applications and other flow control applications. For example, valves are employed in wellbore drilling applications to control the actuation of tools located in the wellbore being drilled. During wellbore drilling operations, valves positioned in a drilling assembly can be selectively actuated to control the direction of drilling. The valves may be positioned, for example, to control the flow of drilling mud to actuating pads which are extended and contracted in a controlled manner to steer the drill bit and thereby drill the wellbore in a desired direction.

In some drilling applications, rotary steerable systems are employed to control the direction of drilling during formation of the wellbore. The rotary steerable systems may utilize a drill bit coupled with a drill collar and rotated to drill through the rock formation. A plurality of steering pads is selectively actuated in a lateral direction to control the direction of drilling, and the steering pads may be controlled by a variety of valves and control systems. In some applications, rotary valves are held at desired angular orientations with respect to the rotating drill collar to control flow of drilling mud to the steering pads. A rotary valve may be held in a geostationary position by a control cartridge in, for example, a strap-down system. However, existing systems are limited in their ability to accurately control the direction of drilling and in providing options for changing the direction of drilling. Existing strap-down systems use a motor to orientate a valve opening but provide no advanced control. The motor either keeps the valve geostationary or allows it to rotate slowly.

SUMMARY

In general, a system and methodology is provided to facilitate control over the directional drilling of a wellbore. A rotational valve is mounted within a drill collar of a rotary steerable system to control flow of actuating fluid to one or more steering pads which are selectively moved in a lateral direction with respect to the rotary steerable system. The rotational valve is designed to provide enhanced control over the flow of actuating fluid to the steering pads to facilitate drilling of straight sections of wellbore and deviated or non-linear sections of wellbore.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for drilling wellbores. The system and methodology employ a rotary steerable system which may be operated to control the direction of drilling during formation of the wellbore. The rotary steerable system comprises one or more steering pads mounted on a drill collar, and the steering pad or pads are selectively actuated to control the orientation of the drill collar in the direction of drilling. The steering pads are actuated by an actuating fluid, and flow of the actuating fluid to the steering pads is controlled by a rotational valve, e.g. a spider valve, which may be operated by a controlled motor.

According to one embodiment, a motor controlled spider valve is used in combination with orientation sensors and a controller, e.g. microprocessor, to enable improved control of the rotary steerable system. For example, operation of the spider valve may be controlled to provide an "off" position which allows the rotary steerable system to direct drilling of a straight section of wellbore. In this example, the off position is enabled by the design of the spider valve which allows all of the actuating/steering pads to be simultaneously activated by the pressure of the actuating fluid, e.g. drilling mud. Alternatively, the spider valve may be designed to prevent flow of the pressurized actuating fluid to any of the actuating/steering pads to allow drilling of the straight section of wellbore.

Figure 1:
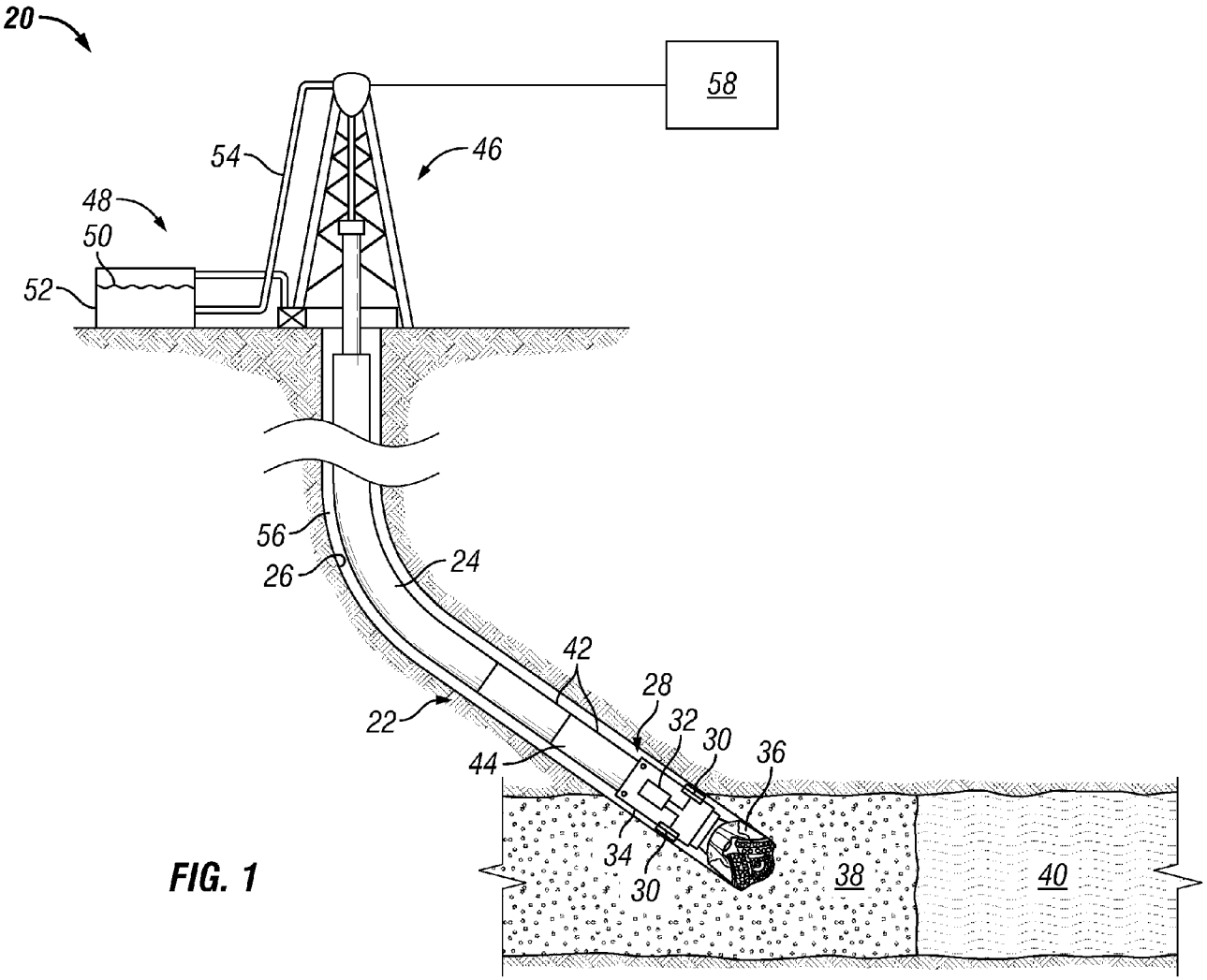
FIG. 1 is a schematic illustration of an example of a drill string which includes a rotary steerable system employing a rotational valve, according to an embodiment of the present invention.

Referring generally to FIG. 1, an embodiment of a drilling system 20 is illustrated as having a bottom hole assembly 22 which is part of a drill string 24 used to form a desired, directionally drilled wellbore 26. The illustrated drilling system 20 comprises a rotary steerable system 28 having at least one laterally movable steering pad 30 controlled by a valve system 32. By way of example, the one or more steering pads 30 may be designed to act against a corresponding pivotable component of the rotary steerable system 28 or against the surrounding wellbore wall to provide directional control. In this particular embodiment, the valve system 32 is positioned within a drill collar 34 of the rotary steerable system 28. The drill collar 34 is coupled with a drill bit 36 which is rotated to cut through a surrounding rock formation 38 which may be in a hydrocarbon bearing reservoir 40.

Depending on the environment and the operational parameters of the drilling operation, drilling system 20 may comprise a variety of other features. For example, drill string 24 may include additional drill collars 42 which, in turn, may be designed to incorporate desired drilling modules, e.g. logging-while-drilling and/or measurement-while-drilling modules 44. In some applications, stabilizers may be used along the drill string to stabilize the drill string with respect to the surrounding wellbore wall.

Various surface systems also may form a part of the drilling system 20. In the example illustrated, a drilling rig 46 is positioned above the wellbore 26 and a drilling fluid system 48, e.g. drilling mud system, is used in cooperation with the drilling rig 46. For example, the drilling fluid system 48 may be positioned to deliver a drilling fluid 50 from a drilling fluid tank 52. The drilling fluid 50 is pumped through appropriate tubing 54 and delivered down through drilling rig 46 and into drill string 24. In many applications, the return flow of drilling fluid flows back up to the surface through an annulus 56 between the drill string 24 and the surrounding wellbore wall. The return flow may be used to remove drill cuttings resulting from operation of drill bit 38. The drilling fluid 50 also may be used as an actuating fluid to control operation of the rotary steerable system 28 and its movable steering pad or pads 30. In this latter embodiment, flow of the drilling/activating fluid 50 to steering pads 30 is controlled by valve system 32 in a manner which enables control over the direction of drilling during formation of wellbore 26.

The drilling system 20 also may comprise many other components, such as a surface control system 58. The surface control system 58 can be used to communicate with rotary steerable system 28. In some embodiments, the surface control system 58 receives data from downhole sensor systems and also communicates commands to the rotary steerable system 28 to control actuation of valve system 32 and thus the direction of drilling during formation of wellbore 26. In other applications, as discussed in greater detail below, control electronics are located downhole in the rotary steerable system 28 and the control electronics cooperate with an orientation sensor to control the direction of drilling. However, the downhole, control electronics may be designed to communicate with surface control system 58, to receive directional commands, and/or to relay drilling related information to the surface control system.

Figure 2:
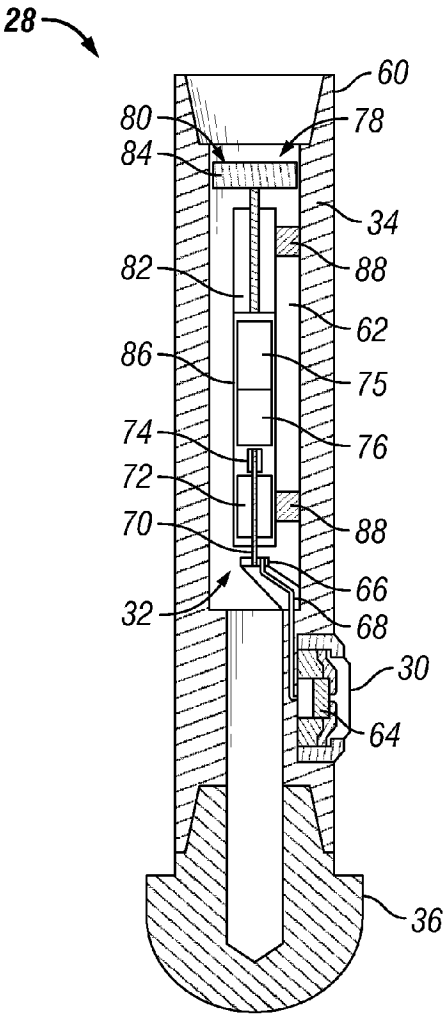
FIG. 2 is a schematic illustration of an example of a rotary steerable system, according to an embodiment of the present invention.

Referring generally to FIG. 2, an illustration is provided of one embodiment of the rotary steerable system 28. In this embodiment, drill bit 36 is mounted to the drill collar 34 which has a connector end 60 opposite drill bit 36. Connector end 60 is designed for coupling the rotary steerable system 28 to the next adjacent, uphole component of drill string 24. Additionally, the drill collar 34 comprises a hollow interior 62 designed to hold a variety of rotary steerable system components. An individual movable steering pad 30 or a plurality of movable steering pads 30 also may be mounted to the drill collar 34 for lateral, e.g. radial movement, with respect to the drill collar. In one example, each steering pad of the plurality of steering pads 30 may be moved by a corresponding piston 64 which is hydraulically actuated via drilling/activating fluid 50 appropriately metered by valve system 32.

In the example illustrated, valve system 32 comprises a rotational valve 66, such as a spider valve. The spider valve 66 may be selectively rotated to enable flow of activating fluid 50 and/or to block flow of activating fluid 50 with respect to selected individual and/or multiple steering pads 30. By way of example, the actuating fluid 50 may be delivered through hydraulic lines 68 to act against pistons 64. During rotation of drill collar 34 and drill bit 36 for drilling of wellbore 26, the spider valve 66 undergoes a controlled, relative rotation to ensure either delivery of the activating fluid 50 through desired hydraulic line 68 to desired movable steering pads 30 or blockage of the activating fluid 50.

As illustrated, spider valve 66 is mounted to a drive shaft 70 which is rotated by a motor 72, such as an electric motor. One or more sensors 74, such as an encoder, also may be operatively engaged with drive shaft 70 to monitor the angular orientation of spider valve 66 relative to the drill collar 34. The rotary steerable system 28 further comprises control electronics 75 which may comprise a micro-controller 76, e.g. a microprocessor. The micro-controller 76 receives data from the sensors/encoder 74 and uses the data to control motor 72 which, in turn, controls the angular positioning of spider valve 66. The controller 76 also may be designed for communication with surface control system 58 to receive commands and/or to relay data. Furthermore, control electronics 75 may comprise additional components, such as a direction and inclination package containing magnetometers and accelerometers. Control over the spider valve position enables a unique control over duration of the side forces applied by one or more steering pads 30. The spider valve 66 moves synchronously with the drill collar 34, and the spider valve may be aligned with corresponding ports or blank spaces to control side force duration as discussed in greater detail below.

Electric power may be provided to controller 76, to motor 72, and to other components of rotary steerable system 28 via a suitable power source 78. By way of example, the power source 78 may comprise batteries and/or a turbine 80. The turbine 80 may comprise an alternator 82 driven by rotation of turbine blades 84 which are rotated by the pressurized flow of drilling/activating fluid 50 down through rotary steerable system 28 and drill bit 36. Several of the features of the rotary steerable system 28 may be mounted within a pressure housing 86 to protect them against the relatively high pressures of the drilling/activating fluid 50. For example, motor 72, encoder 74, controller 76, and alternator 82 may be disposed within a pressure housing 86. In this embodiment, the pressure housing 86 is rigidly attached to the drill collar 34 with suitable mounting structures 88, e.g. centralizers, disposed in the hollow interior 62 of drill collar 34. Thus, the pressure housing 86 rotates with the drill collar 34.

The rotary steerable system 28 comprises at least one movable steering pad 30, e.g. 1, 2, 3 or 4 movable steering pads, which are activated by the differential pressure between the inside and outside of the drill collar 34. When a particular steering pad 30 is activated and pushes against, for example, the surrounding formation, the rotary steerable system 28 is deflected in the opposite direction and provides the steering capability. As the drill collar 34 rotates, the spider valve 66 is able to selectively open or shut off pads 30 by allowing actuating fluid 50 to enter the selected hydraulic line 68 which delivers the actuating fluid 50 to the piston 64 behind the corresponding steering pad 30. The spider valve 66 is rotated by shaft 70 which is driven by motor 72 while the shaft encoder (or other sensor) 74 measures the rotational angle of the spider valve 66 relative to the drill collar 34. The shaft encoder 74 is a unique feature and may be mounted on the shaft 70 to allow the controller 76 or other processor to track the orientation of the spider valve 66 with respect to the drill collar 34.

By controlling the position of rotational valve 66, e.g. spider valve, with electric motor 72, substantially greater steering capabilities are enabled. For example, the spider valve 66 may be designed to simultaneously open flow of actuating fluid 50 to all of the steering pads 30. Consequently, all of the steering pads are activated simultaneously so that no side force is generated and straight sections of wellbore may be drilled more accurately. In this situation, the activated steering pads 30 may be designed to function as a near bit, full gauge stabilizer operating in combination with a fixed stabilizer above the rotary steerable system 28 to enable drilling of a straight hole rather than a slightly spiral hole approximating a straight hole. In an alternate embodiment, the spider valve 66 may be designed to simultaneously block flow of actuating fluid to all of the steering pads 30, thereby preventing generation of side force and thus causing drilling of a straight section of wellbore.

Additionally, the motor controlled spider valve 66 also can be operated and controlled to drill wellbore doglegs of varying build-rates according to several methods, such as varying the duration of the side force during each rotation of the drill collar 34. Also, by extending the movable steering pads 30 during drilling of straight wellbore sections or by preventing flow of actuating fluid to the steering pads, the steering pads 30 are not being continually stroked. This leads to greater longevity with respect to piston seals. Effectively, the duty cycle of the steering system is reduced which increases the reliability of the overall rotary steerable system 28.

In FIG. 1, the steering pads 30 are illustrated as acting against a surrounding wellbore wall. However, the rotary steerable system 28 may have a variety of other designs including hybrid designs which include features of both point-the-bit and push-the-bit systems. In such hybrid systems, the hydraulic lines 68 may deliver actuating fluid to corresponding pistons/pads to deflect a stabilizer sleeve. The deflection or pivotable movement of the stabilizer sleeve controls, e.g. changes, the direction of drilling.

Figure 3:
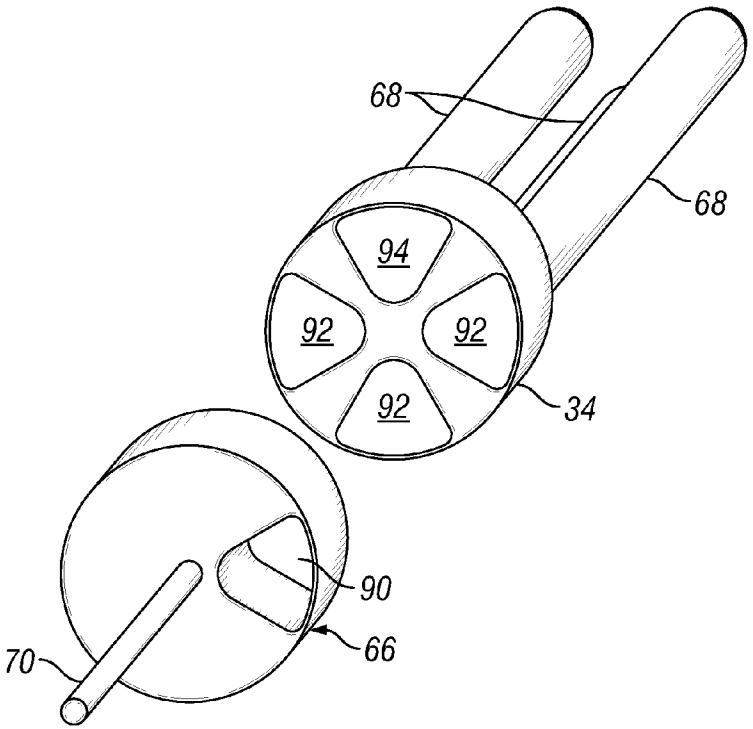
FIG. 3 is an exploded view of a rotational valve or spider valve which controls flow of actuating fluid to a plurality of steering pads via corresponding flow ports, according to an embodiment of the present invention.

Referring generally to FIG. 3, an exploded view of an embodiment of the spider valve 66 and corresponding drill collar ports is illustrated. In this embodiment, the spider valve 66 comprises a valve opening 90 which may be rotated to desired angular positions via motor 72. The valve opening 90 may be selectively aligned with individual, corresponding ports 92 which are part of and rotate with drill collar 34. The ports 92 deliver actuating fluid 50 into hydraulic lines 68 and on to the corresponding steering pads 30. In the specific example illustrated, the drill collar 34 comprises three corresponding ports 92 connected to three steering pads 30 via hydraulic lines 68. The valve opening 90 also may be selectively aligned with a collective port 94 which is hydraulically coupled with all of the steering pads 30, e.g. three steering pads 30. It should be noted that additional corresponding ports 92 and additional steering pads 30 may be used in some rotary steerable system designs. A plurality of activating ports 92 is illustrated to facilitate explanation. However, a single port 92 may be employed to control a single steering pad 30. If a single pad 30 and port 92 are employed, the principle remains the same as described with respect to the plurality of pads and ports. Additionally, if certain pads fail to function properly, steering may still be achieved with a pair of steering pads or with a single steering pad 30.

The spider valve 66 is selectively rotated via shaft 70 and motor 72 to bring valve opening 90 into alignment or out of alignment with selected, corresponding ports 92 and/or collective port 94. To facilitate an understanding of the angular relationship of valve opening 90 with respect to corresponding ports 92 and collective port 94, corresponding ports 92 have been labeled as first (1), second (2) and third (3) ports and collective port 94 has been labeled as the fourth (4) port. The first (1), second (2) and third (3) ports correspond with first, second and third movable steering pads 30, and the fourth (4) port corresponds with all of the movable steering pads 30. The valve opening 90 may be selectively aligned with desired ports 92, 94 to control the directional drilling of deviated sections and/or straight sections of wellbore 26, as explained in greater detail below.

Figure 4A:
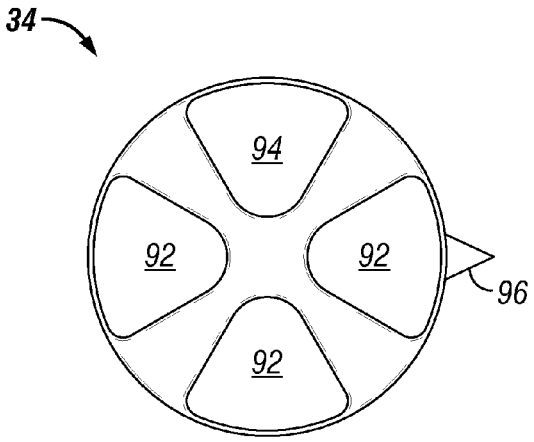
FIG. 4 is a schematic illustration showing the angular position of a valve opening through the rotational valve and the angular position of flow ports, according to an embodiment of the present invention.
Figure 4B:
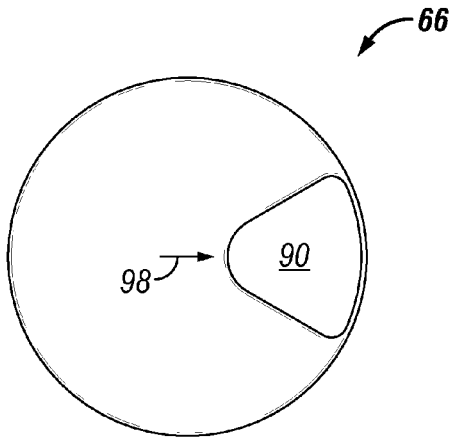
Figure 4C:
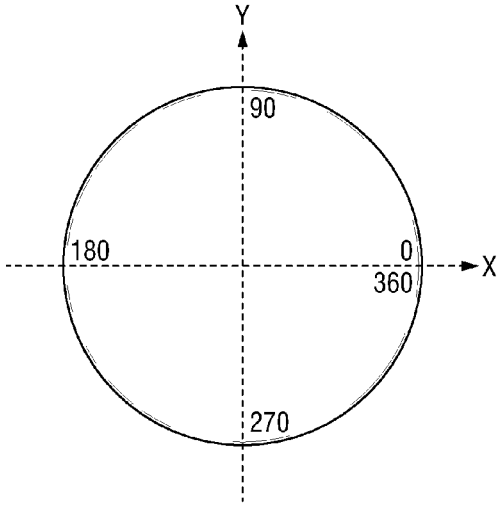
Figure 5:
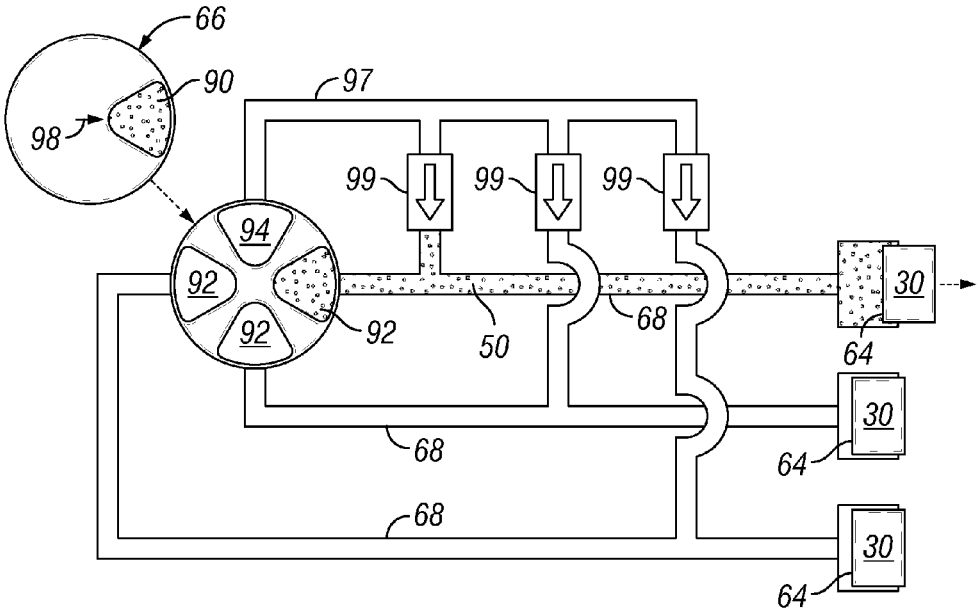
FIG. 5 is a schematic illustration showing the angular position of the valve opening to enable flow of actuating fluid to a first steering pad, according to an embodiment of the present invention.
Figure 6:
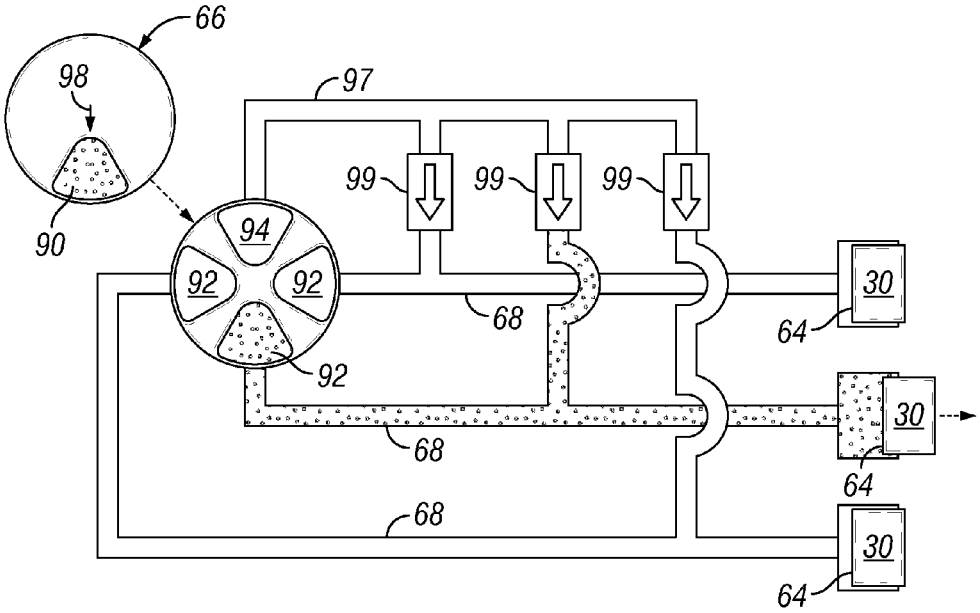
FIG. 6 is a schematic illustration showing the angular position of the valve opening to enable flow of actuating fluid to a second steering pad, according to an embodiment of the present invention.
Figure 7:
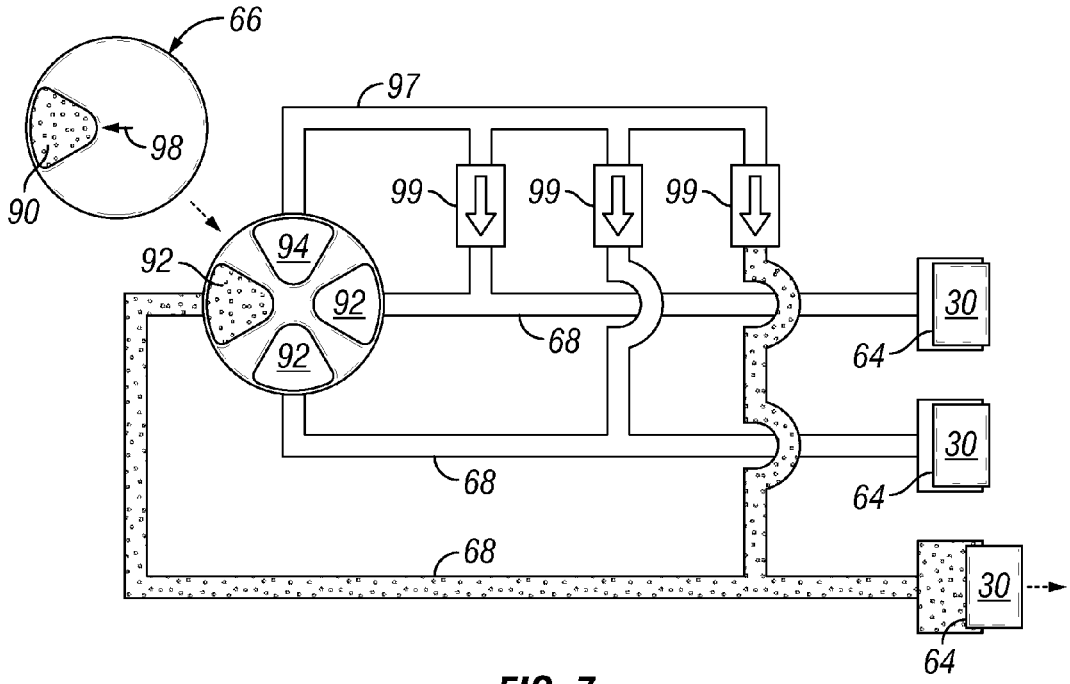
FIG. 7 is a schematic illustration showing the angular position of the valve opening to enable flow of actuating fluid to a third steering pad, according to an embodiment of the present invention.

In FIG. 4, a schematic illustration shows the spider valve 66 with its valve opening 90 located at 0°. The first (1), second (2), and third (3) ports 92 of the drill collar are illustrated as positioned at 0°, 270° and 180°, respectively. The fourth (4) port 94 of the drill collar is illustrated as positioned at 90°. The size of the valve opening 90 and ports 92, 94 may vary according to a variety of design parameters. In one example, however, the valve opening 90 and the ports 92, 94 each has an angular width of 56°. However, the angular widths and radial lengths of the valve opening 90 and ports 92, 94 may be changed for different applications. In this particular example, the movable steering pads 30 are located at angular positions around the drill collar 34 at 120° apart. Thus, there is an asymmetric angular relationship between the ports 92, 94 and the steering pads 30. FIG. 4 and subsequent figures employ a triangular marker 96 which indicates the rotational angle of the drill collar 34 and its first (1) port. Similarly, an arrow marker 98 is employed to indicate the rotational angle of the spider valve 66 and valve opening 90.

Referring generally to FIGS. 5-8, the flow of actuating fluid, e.g. drilling mud, to actuate one or more corresponding steering pads 30 is illustrated schematically as controlled by spider valve 66. In the operational position illustrated in FIG. 5, for example, spider valve 66 is rotated to temporarily maintain valve opening 90 in alignment with the first (1) port 92 to deliver activating fluid 50 through hydraulic line 68 to the first corresponding piston 64 and steering pad 30. Displacement of the first steering pad 30 over a portion of the rotation of drill collar 34 applies a side force to the drill collar 34 and to rotary steerable system 28. In the operational position illustrated in FIG. 6, spider valve 66 is rotated to temporarily maintain valve opening 90 in alignment with the second (2) port 92 to deliver activating fluid 50 through another hydraulic line 68 to the second corresponding piston 64 and steering pad 30 to again apply a side force. In the operational position illustrated in FIG. 7, spider valve 66 is rotated to temporarily maintain valve opening 90 in alignment with the third (3) port 92 to deliver activating fluid 50 through another hydraulic line 68 to the third corresponding piston 64 and steering pad 30 to again apply a side force.

Figure 8:
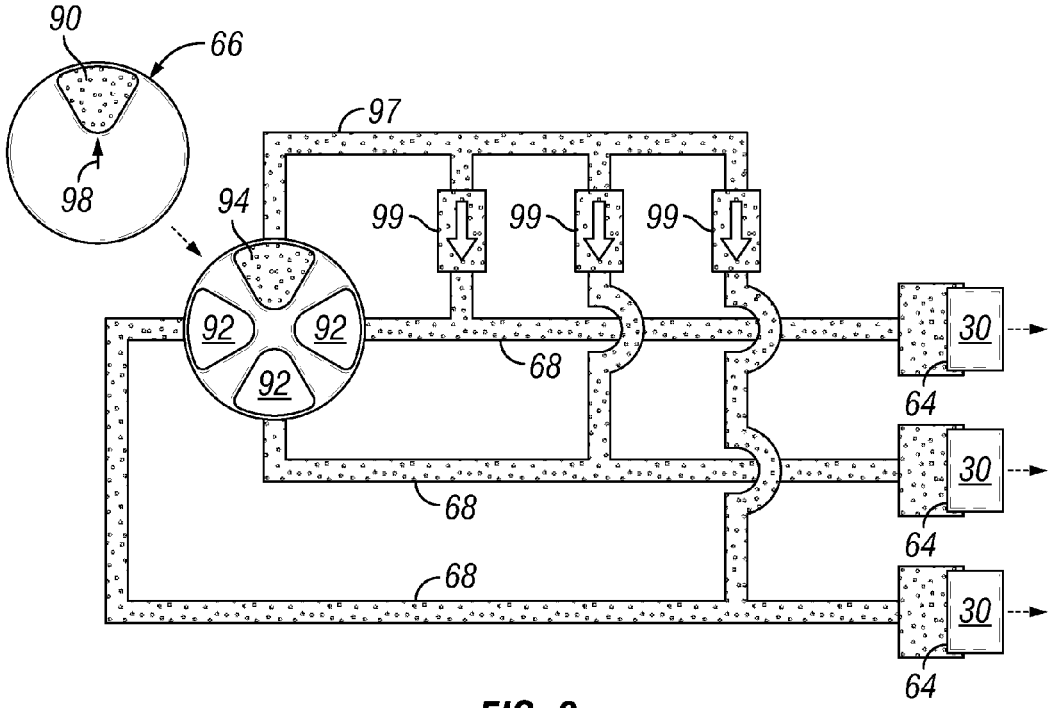
FIG. 8 is a schematic illustration showing the angular position of the valve opening to enable flow of actuating fluid to all of the steering pads simultaneously, according to an embodiment of the present invention.

However, when a straight section of the wellbore 26 is to be drilled, spider valve 66 is rotated to maintain valve opening 90 in alignment with the fourth (4) port 94, as illustrated in FIG. 8. In this operational position, activating fluid 50 is delivered into a hydraulic connector line 97 which is connected with the three hydraulic lines 68 across three check valves 99. The check valves 99 only allow activating fluid 50, e.g. drilling mud, to flow in one direction indicated by the arrows, thus preventing actuating fluid from inadvertently actuating other steering pads 30 during directional drilling. The hydraulic activating fluid 50 flows through the check valves 99, into hydraulic lines 68, and simultaneously actuates all of the pistons 64 and steering pads 30. When all of the steering pads 30 are simultaneously actuated, the drill collar 34 and rotary steerable system 28 are not forced in a lateral direction, i.e. there is no net side force on the drill bit 36. Consequently, drilling occurs in a straight line. In the example illustrated, three check valves 90, three hydraulic line 68, and three steering pads 30 are shown. However, the number of check valves 90, hydraulic lines 68, and steering pads 30 may vary according to the application. For example, some applications may employ four steering pads.

Because the spider valve 66 is driven by a motor 72 under the control of micro-controller 76, the spider valve 66 may be used to selectively open any port 92, 94 at any drill collar angle. Consequently, the system provides a wide range of steering options. To drill a straight hole, for example, spider valve 66 rotates at the same RPM as the drill collar and maintains the valve opening 90 in alignment with the fourth (4) port 94. In the graphical illustration of FIG. 9, a plot is provided of the angular positions of the first (1), second (2) and third (3) ports 92 as represented by graph lines 100, 102 and 104, respectively. The angular position of ports 92 are plotted against the angular position of the spider valve 66 which maintains valve opening 90 in alignment with the fourth (4) port 94 (as represented by graph line 106) for a full rotation of the drill collar 34. In this application, the spider valve 66 rotates at the same RPM as the drill collar 34, and the valve opening 90 remains aligned with the fourth (4) ports 94 during the full 360° of rotation.

If a side force is to be applied to the rotary steerable system 28 to drill a curved wellbore section, the spider valve 66 is controlled via motor 72 and controller 76 to activate the steering pads 30 in sequence to apply a controlled side force to the rotary steerable system 28 and drill bit 36. For example, to generate a maximum deflection or other desired deflection in the negative x-direction, the spider valve 66 opens flow of activating fluid 50 to the steering pads 30 when they are aligned in the positive x-direction. An example of a sequence of spider valve movements to apply a maximum side force is illustrated in FIGS. 10-14.

As illustrated, individual ports 92 are selectively opened in a manner which allows activating fluid 50 to activate a corresponding steering pad 30 while the other ports 92, 94 are closed. In FIG. 10, the side force is applied primarily in a positive x-direction to deflect the rotary steerable system 28 toward the negative x-direction. FIG. 10 illustrates a sequence of drill collar 34 and spider valve 66 rotational movements that produce a relatively large side force. In this illustration, the angular position of the drill collar 34 ranges from 0° to 90° while the angular positions of the spider valve 66 are controlled to enable generation of the desired side force.

As illustrated, the spider valve angle is the same as the drill collar angle from 0° to 50°. During this portion of rotation, the valve opening 90 is maintained in alignment with the first (1) port 92 to enable flow to the corresponding first steering pad 30. Once the 50° angular position is reached, the spider valve 66 is rotated rapidly 90° in the clockwise direction so the first (1) port 92 is closed and the second (2) port 92 is opened to pressurized activating fluid 50 to enable actuation of the second steering pad 30. FIG. 11 illustrates movement of the valve opening 90 with the second (2) port 92 as the drill collar rotates from 90° to 190°. The spider valve 66 is controlled to rotate with the drill collar 34 so that the second steering pad remains activated until the drill collar angle reaches 170°. Then, the spider valve 26 is quickly rotated 90° in the clockwise direction so the second (2) port is closed and the third (3) port is opened to pressurized actuating fluid 50 to enable actuation of the third steering pad 30. FIG. 12 illustrates movement of the valve opening 90 with the third (3) port 92 as the drill collar rotates from 190° to 290°. The spider valve 66 is controlled to rotate with the drill collar 34 so that the third steering pad remains activated until the drill collar angle reaches 290°. Then, the spider valve 26 is quickly rotated in the clockwise direction by 180° to again align with the first (1) port 92, as illustrated in FIG. 13. Because the spider valve rotates through 180°, the rate of rotation in this instance should be twice as fast as during the other clockwise transitions. FIG. 13 illustrates the angular position of the spider valve 66 for drill collar angles ranging from 290° to 360°. It should be noted that the fourth (4) port 94 is briefly opened as the drill collar 34 rotates past the 300° position.

Figure 14:
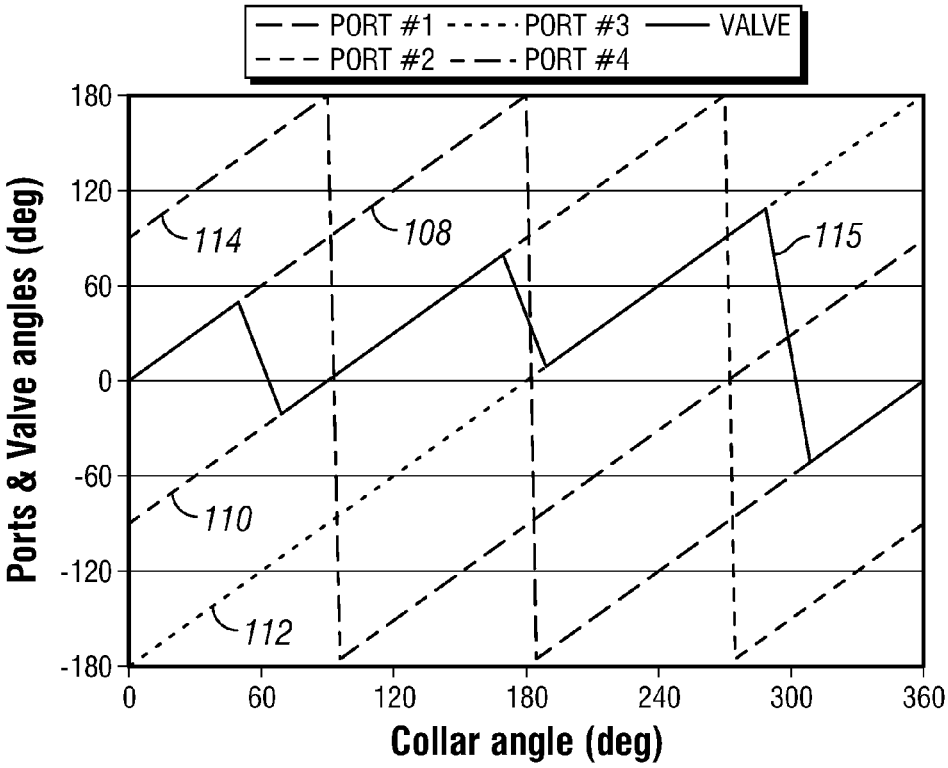
FIG. 14 is a graphical representation showing the drill collar angle versus the angular position of the rotational valve opening and the flow ports during production of side forces to cause drilling of a curve, according to an embodiment of the present invention.

In FIG. 14, the drill collar angle as represented by triangular marker 96 is plotted versus the angular position of first (1), second (2), and third (3) ports 92 as well as fourth (4) port 94 (see graph lines 108, 110, 112 and 114, respectively). The drill collar angle also is plotted versus the angular position of the spider valve 66 (see graph line 115). However, the relative angular positions as well as the rotational speeds of the spider valve 66 and drill collar 34 may be selected according to the parameters of a specific application.

When only one port 92 is open at any instant, the forces on the bottom hole assembly/rotary steerable system can be calculated from the angle of the drill collar 34. The forces acting on the rotary steerable system in the x and y directions are given by $Fx=-F\cos(\theta)$ and $Fx=-F\sin(\theta)$ where $\theta$ is the angle of the drill collar modulo 120° and where F is the force the steering pad 30 exerts against the borehole wall. The force F is equal to the area of the hydraulic piston 64 times the differential pressure ($\Delta P$) between the piston chamber of the steering pad 30 and the borehole pressure. Provided the valve openings and the port openings are sufficiently large, the differential pressure is equal to the pressure drop between the inside and outside of the drill collar 34.

Figure 15:
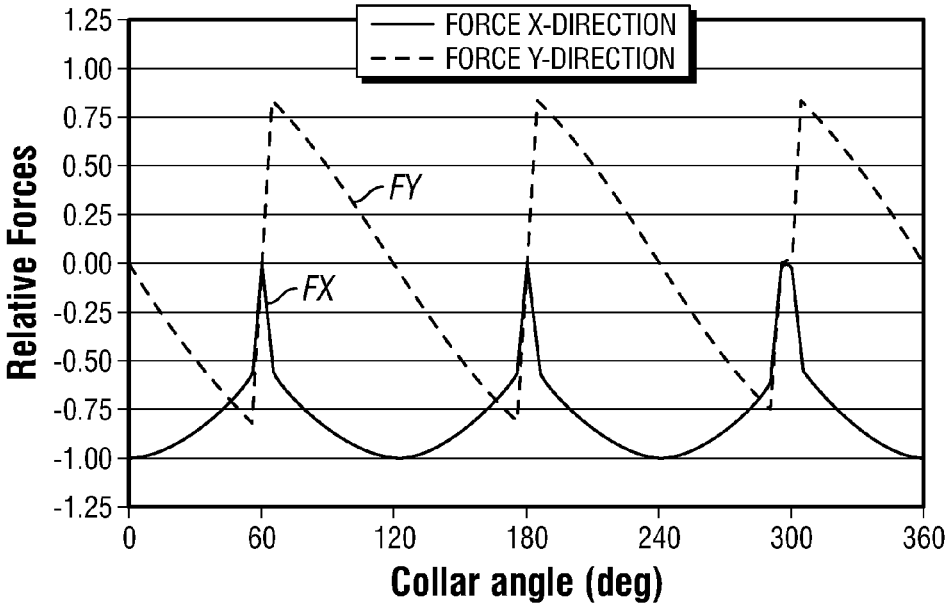
FIG. 15 is a graphical representation showing the drill collar angle versus the relative forces generated in the x and y directions, according to an embodiment of the present invention.

The x and y components of the force are plotted versus the angular position of the drill collar 34 in the graph of FIG. 15. The force in the x-direction is never positive ($Fx \leqq 0$) while the force in the y-direction is equally applied in the positive and negative directions. As illustrated, large excursions occur in the Fy component but the average force in the y-direction is zero. The drill bit deflection is proportional to the force component averaged over a revolution of the drill collar:

$$\langle Fx \rangle = \frac{1}{2\pi}\int_0^{2\pi} Fx(\theta)d\theta \text{ and } \langle Fy \rangle = \frac{1}{2\pi}\int_0^{2\pi} Fy(\theta)d\theta.$$

As noted above, <Fy> equals zero and therefore no net deflection occurs in the y-direction.

Figure 9:
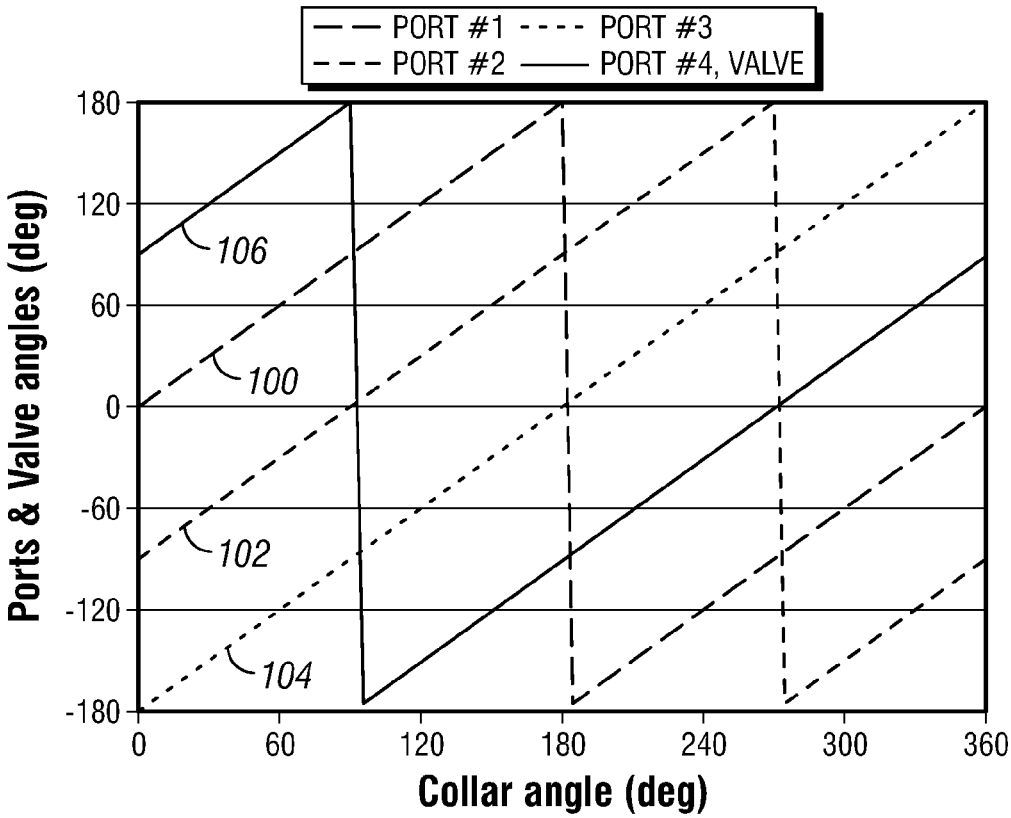
FIG. 9 is a graphical representation showing the drill collar angle versus the angular position of the rotational valve opening and the flow ports, according to an embodiment of the present invention.
Figure 10A:
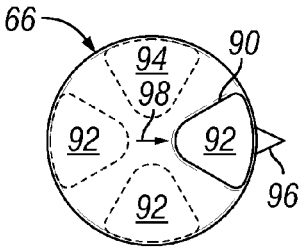
FIG. 10 is a schematic illustration of the corresponding positions of the rotational valve opening and the corresponding flow ports during operation of the rotary steerable system when a side force is generated through an angular range during rotation of the drill collar from 0° to 90°, according to an embodiment of the present invention.
Figure 10B:
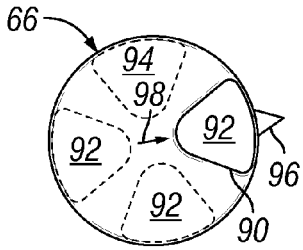
Figure 10C:
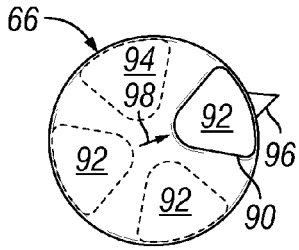
Figure 10D:
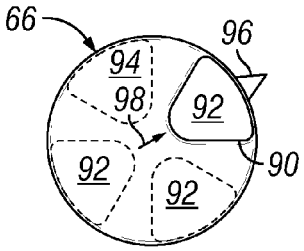
Figure 10E:
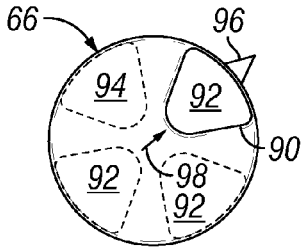
Figure 10F:
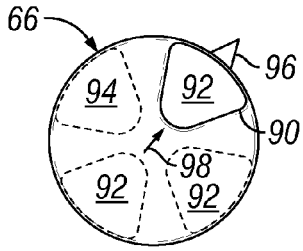
Figure 10G:
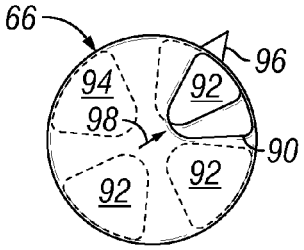
Figure 10H:
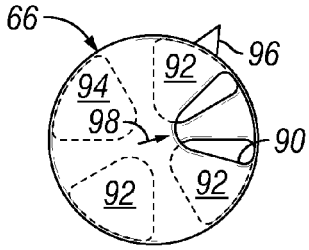
Figure 10I:
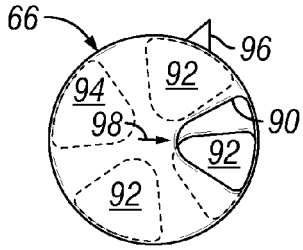
Figure 10J:
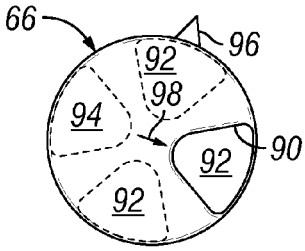
Figure 10K:
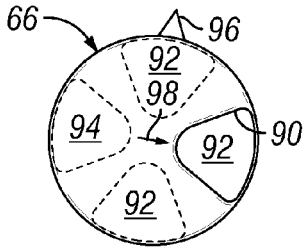
Figure 10L:
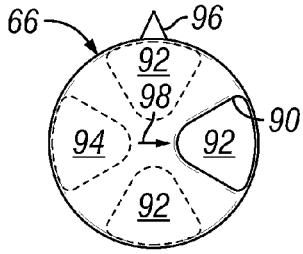
Figure 11A:
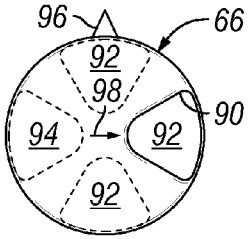
FIG. 11 is a schematic illustration of the corresponding positions of the rotational valve opening and the corresponding flow ports during operation of the rotary steerable system when a side force is generated through an angular range during rotation of the drill collar from 90° to 190°, according to an embodiment of the present invention.
Figure 11B:
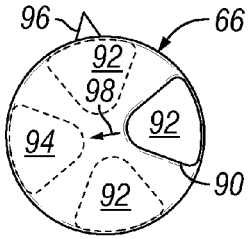
Figure 11C:
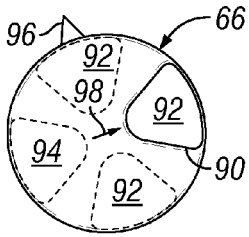
Figure 11D:
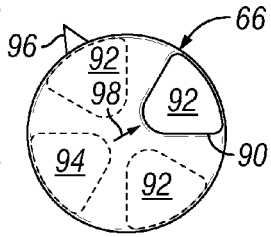
Figure 11E:
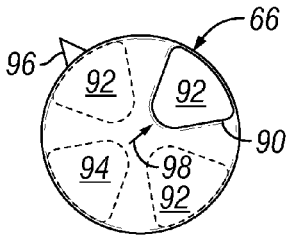
Figure 11F:
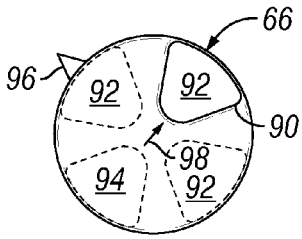
Figure 11G:
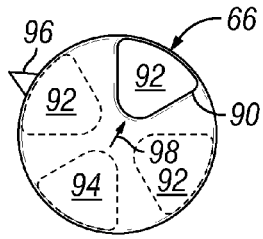
Figure 11H:
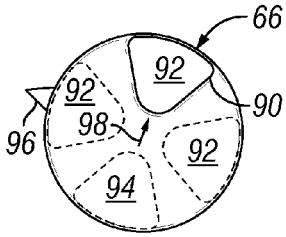
Figure 11I:
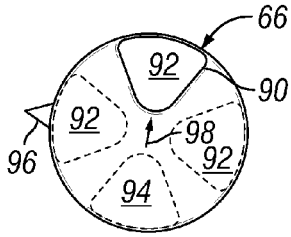
Figure 11J:
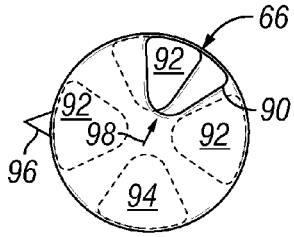
Figure 11K:
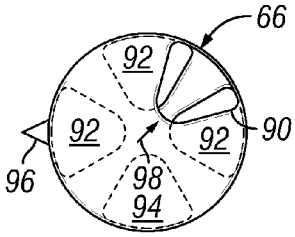
Figure 11L:
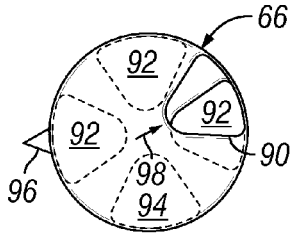
Figure 11M:
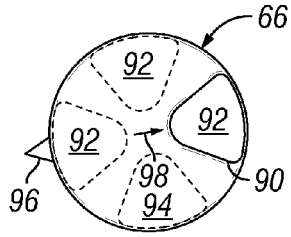
Figure 12A:
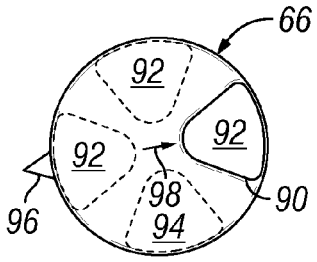
FIG. 12 is a schematic illustration of the corresponding positions of the rotational valve opening and the corresponding flow ports during operation of the rotary steerable system when a side force is generated through an angular range during rotation of the drill collar from 190° to 290°, according to an embodiment of the present invention.
Figure 12B:
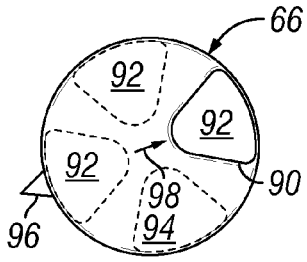
Figure 12C:
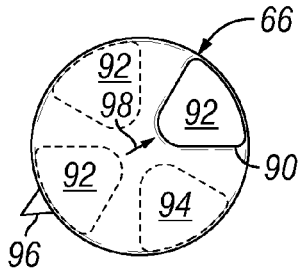
Figure 12D:
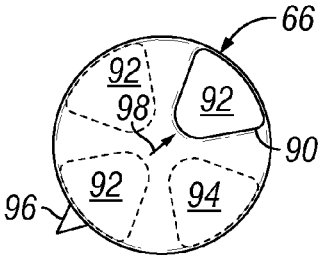
Figure 12E:
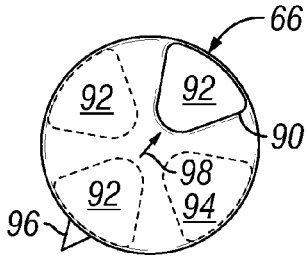
Figure 12F:
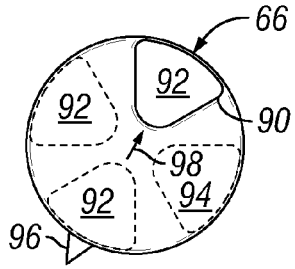
Figure 12G:
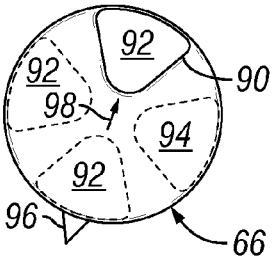
Figure 12H:
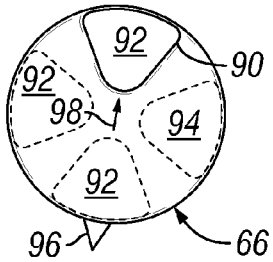
Figure 12I:
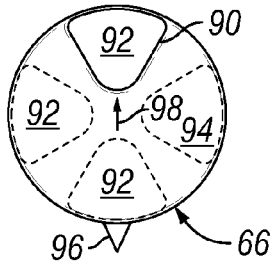
Figure 12J:
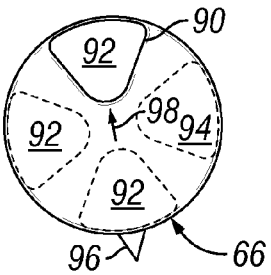
Figure 12K:
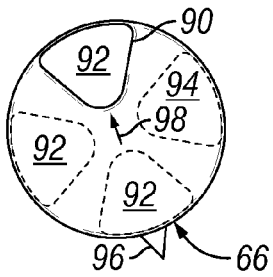
Figure 13A:
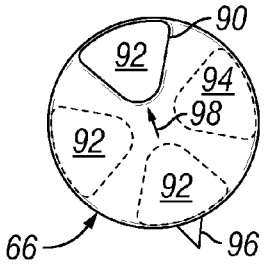
FIG. 13 is a schematic illustration of the corresponding positions of the rotational valve opening and the corresponding flow ports during operation of the rotary steerable system when a side force is generated through an angular range during rotation of the drill collar from 290° to 360°, according to an embodiment of the present invention.
Figure 13B:
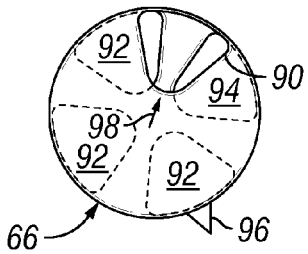
Figure 13C:
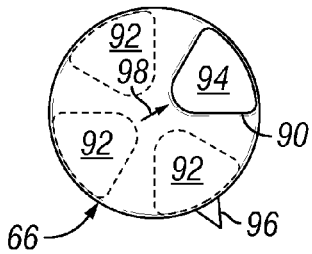
Figure 13D:
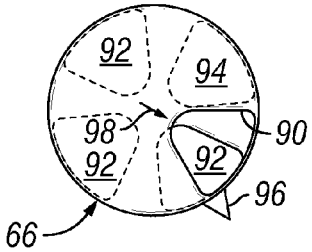
Figure 13E:
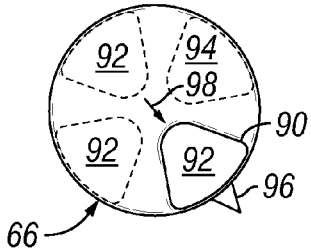
Figure 13F:
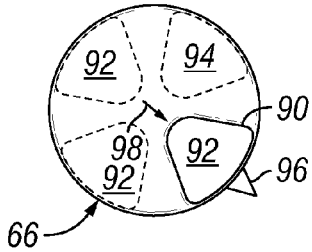
Figure 13G:
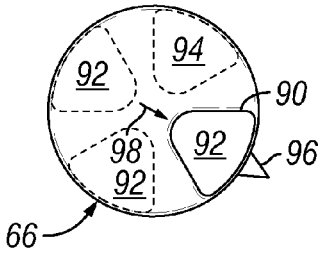
Figure 13H:
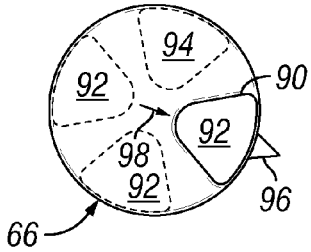
Figure 13I:
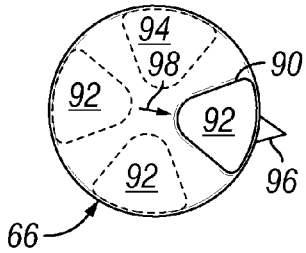
Figure 13J:
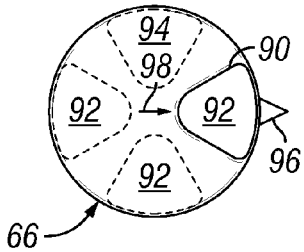

To reduce the dogleg severity during drilling of wellbore 26, the spider valve 26 may be controlled to alternate between the two drilling modes described above, i.e. alternating between drilling a straight hole and drilling at a maximum deflection. For example, all steering pads 30 may be activated during one rotation of drill collar 34 as illustrated in FIGS. 8 and 9. However, the selective activation of single steering pads 30 may be employed to drill at an angle (dogleg) during the next rotation of drill collar 34 as illustrated in FIGS. 10-14. By varying the number of rotations for the two modes, a range of doglegs or directional drilling angles can be achieved from a deviation angle of zero to a maximum possible deviation angle.

Another method which may be employed to control the dogleg severity is to selectively activate steering pads 30 during a single rotation of the drill collar 34. For example, the spider valve 66 may be operated to align the valve opening 90 with the first (1) port 92 to activate the corresponding first steering pad 30 for drill collar angles from 0° to 60°. The spider valve 66 may then be controlled to align the valve opening 90 with the second (2) port 92 to activate the second steering pad 30 for drill collar angles from 60° to 120°. Subsequently, spider valve 66 may be controlled to align the valve opening 90 with the fourth (4) port 94 so all three steering pads 30 are simultaneously actuated for drill collar angles from 120° to 360°, thereby limiting the dogleg severity. Increased dogleg severity may be achieved by activating single steering pads 30 to create side forces over the drill collar angles from, for example, 0° to 240° but not from 240° to 360°. Various methods for controlling dogleg severity, such as those described above, may be combined to alternate between drilling straight sections in which all three steering pads 30 are activated and drilling deviated sections in which steering pads 30 are individually activated.

Figure 16:
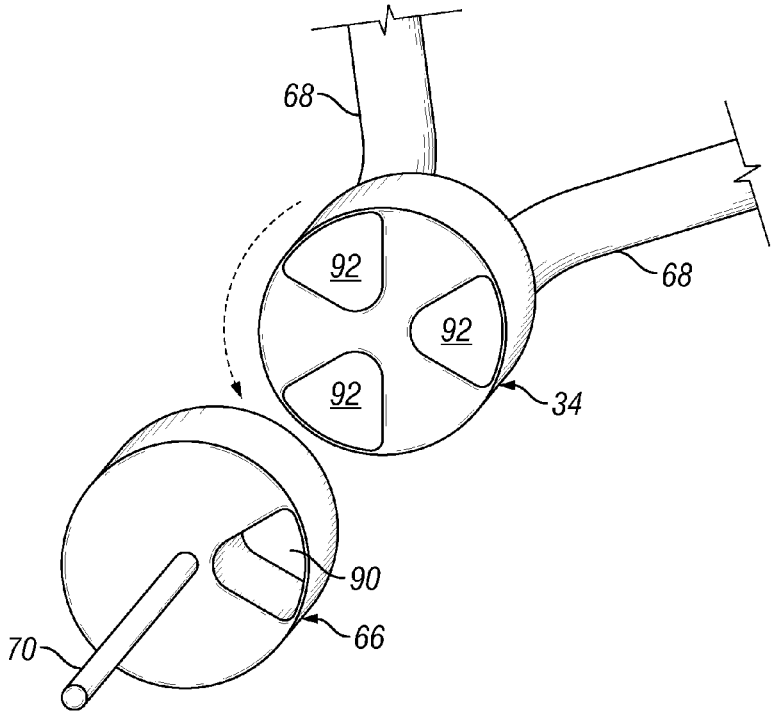
FIG. 16 is an exploded view of an alternate example of the rotational valve/spider valve controlling flow of actuating fluid to a plurality of steering pads via corresponding flow ports, according to an embodiment of the present invention.

An alternate embodiment of spider valve 66 is illustrated in FIG. 16 in which an exploded view of spider valve 66 and corresponding drill collar ports 92 is illustrated. In this embodiment, the spider valve 66 again comprises the single valve opening 90 which may be rotated to desired angular positions via motor 72. The valve opening 90 may be selectively aligned with individual, corresponding ports 92 which are part of and rotate with drill collar 34. The ports 92 deliver actuating fluid 50 into hydraulic lines 68 and on to the corresponding steering pads 30. In the specific example illustrated, the drill collar 34 comprises three corresponding ports 92 connected to three steering pads 30 via hydraulic lines 68. However, this embodiment does not employ the collective port 94 discussed above. Instead, the sizing of valve opening 90 and the angular spacing between ports 92 is designed to allow valve opening 90 to be positioned between ports 92 so no activating fluid 50 flows to the pistons 64 and steering pads 30.

When no activating fluid 50 flows to the steering pads 30, all of the steering pads remain collapsed at the same time. Wear and tear on the rotary steerable system 28 is thus reduced because the steering pads 30 are retracted during drilling of straight hole sections of the wellbore 26. Additionally, the hydraulic pistons 64 which open steering pads 30 are no longer stroked during straight drilling, thereby increasing the lifetime of seals. By reducing the duty cycle of the system, reliability is improved. It should be noted that additional corresponding ports 92 and additional steering pads 30 may be used in some rotary steerable system designs.

The spider valve 66 is selectively rotated via shaft 70 and motor 72 to bring valve opening 90 into alignment or out of alignment with selected, corresponding ports 92. To facilitate an understanding of the angular relationship of valve opening 90 with respect to corresponding ports 92, the corresponding ports 92 have been labeled as first (1), second (2) and third (3) ports. The first (1), second (2) and third (3) ports 92 correspond with first, second and third movable steering pads 30. The valve opening 90 may be selectively aligned with desired ports 92 to control the directional drilling of deviated sections of wellbore 26. Additionally, the valve opening 90 may be selectively positioned in a no flow location between adjacent ports 92 to prevent flow to steering pads 30 (and thus collapse the steering pads 30) during drilling of straight sections of wellbore 26, as explained in greater detail below.

Figure 17:
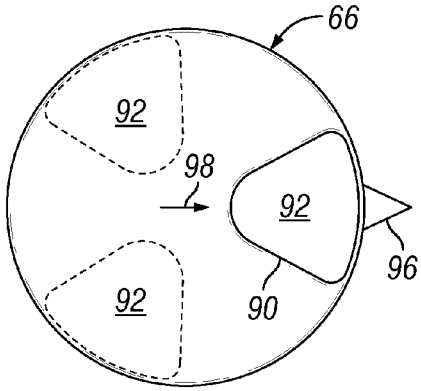
FIG. 17 is a schematic illustration of an operational position of the rotational valve with respect to the flow ports, according to an embodiment of the present invention.
Figure 18:
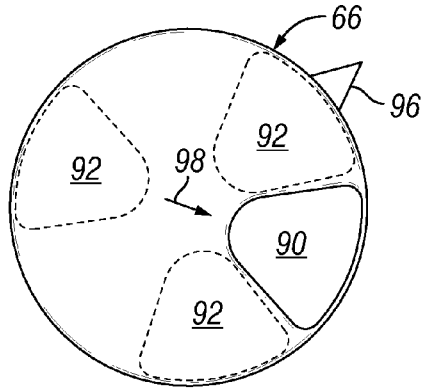
FIG. 18 is a schematic illustration of another operational position of the rotational valve with respect to the flow ports, according to an embodiment of the present invention.

In FIG. 17, a front view is provided of the alternate embodiment in which spider valve 66 is illustrated at a selected angular orientation with respect to drill collar 34 and ports 92. The ports 92 behind spider valve 66, i.e. the ports closed by spider valve 66, are shown in dashed lines. In this example, the valve opening 90 is aligned with the first (1) port 92 to allow flow of pressurized actuating fluid 50 to the first steering pad 30. Flow through second (2) and third (3) ports 92 is blocked. In FIG. 18, the relative angular position of spider valve 66 has been changed with respect to ports 92 so that valve opening 90 is closed by locating the valve opening 90 at an angular position between first (1) and second (2) ports 92 to prevent flow to any of the movable steering pads 30 via hydraulic lines 68. In the example illustrated, three ports 92 control flow to three corresponding steering pads 30, however other numbers of ports 92 and steering pads 30, e.g. four, may be employed in certain applications.

Figure 19A:
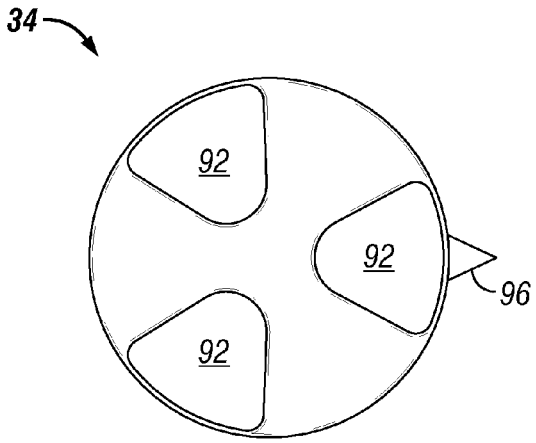
FIG. 19 is a schematic illustration showing the angular position of the valve opening through the rotational valve and the angular position of flow ports of the example illustrated in FIG. 16, according to an embodiment of the present invention.
Figure 19B:
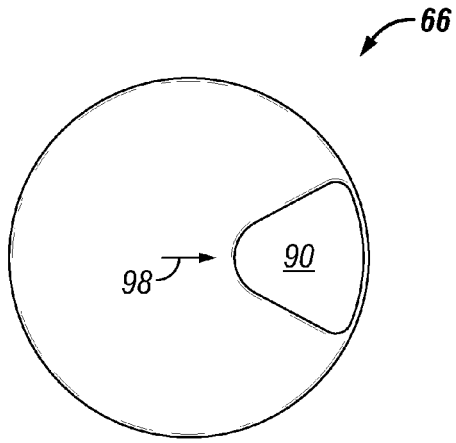
Figure 19C:
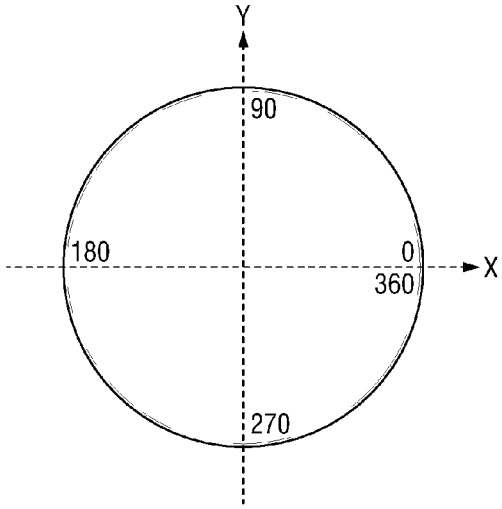
Figure 20A:
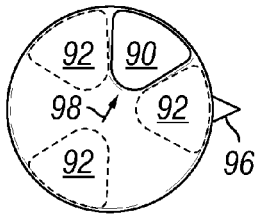
FIG. 20 is a schematic illustration of the corresponding positions of the rotational valve opening and the corresponding flow ports of the embodiment of FIG. 16 during operation of the rotary steerable system when no side force is generated, according to an embodiment of the present invention.
Figure 20B:
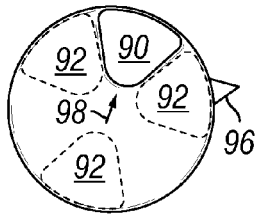
Figure 20C:
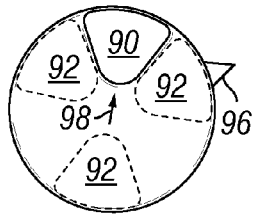
Figure 20D:
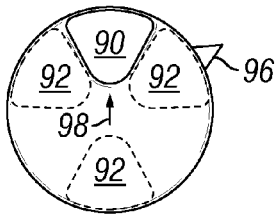
Figure 20E:
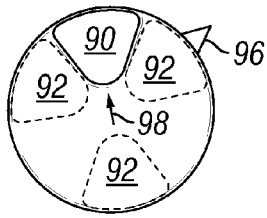
Figure 20F:
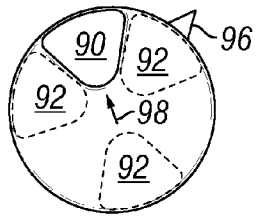
Figure 20G:
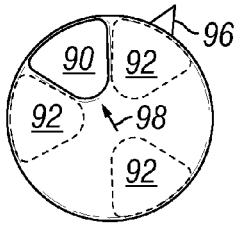
Figure 20H:
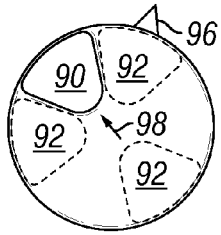
Figure 20I:
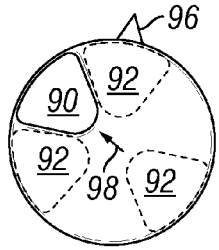
Figure 20J:
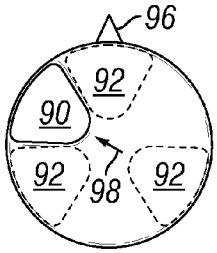
Figure 20K:
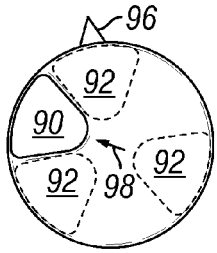
Figure 20L:
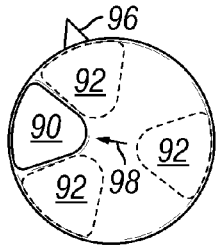
Figure 20M:
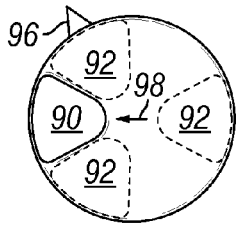

When the spider valve 66 is positioned as illustrated in FIG. 17, the spider valve has the valve opening 90 located at 0°. The first (1), second (2), and third (3) ports 92 of the drill collar are positioned at 0°, 120°, and 240°, as further illustrated in FIG. 19. The size of the various valve openings and ports may vary according to a variety of design parameters. In one example, however, the valve opening 90 has an angular width of 56° which corresponds with the angular width of each of the ports 92. However, the angular widths and radial lengths of the valve opening 90 and ports 92 may be changed for different applications. It should be noted, however, that the ports 92 need not be angularly spaced with equal angular separation. For example, the three ports 92 can be positioned at 0°, 90°, and 270° or other suitable locations. In this latter example, no port 92 exists at 180°, so this location can be used as a no flow region where the opening 90 is parked when spider valve 66 is rotated to close flow with respect to the three steering pads 30.

Referring generally to FIG. 20, a schematic sequence of spider valve positions relative to ports 92 of the rotating drill collar 34 is illustrated to show how spider valve 66 may be employed to drill straight sections of wellbore 26 by not producing any side force. In this illustration, the drill collar angle increases from 0° to 120° in 10° increments. The spider valve 66 maintains a relative angle of 60° with respect to the drill collar 34 so that the valve opening 90 in the spider valve 66 remains parked between first (1) and third (3) ports 92. Hence, all three ports 92 are blocked and thus all three steering pads 30 are collapsed. In this example, three ports 92 are employed, so three "off" positions exist between adjacent or sequential ports 92.

Figure 21:
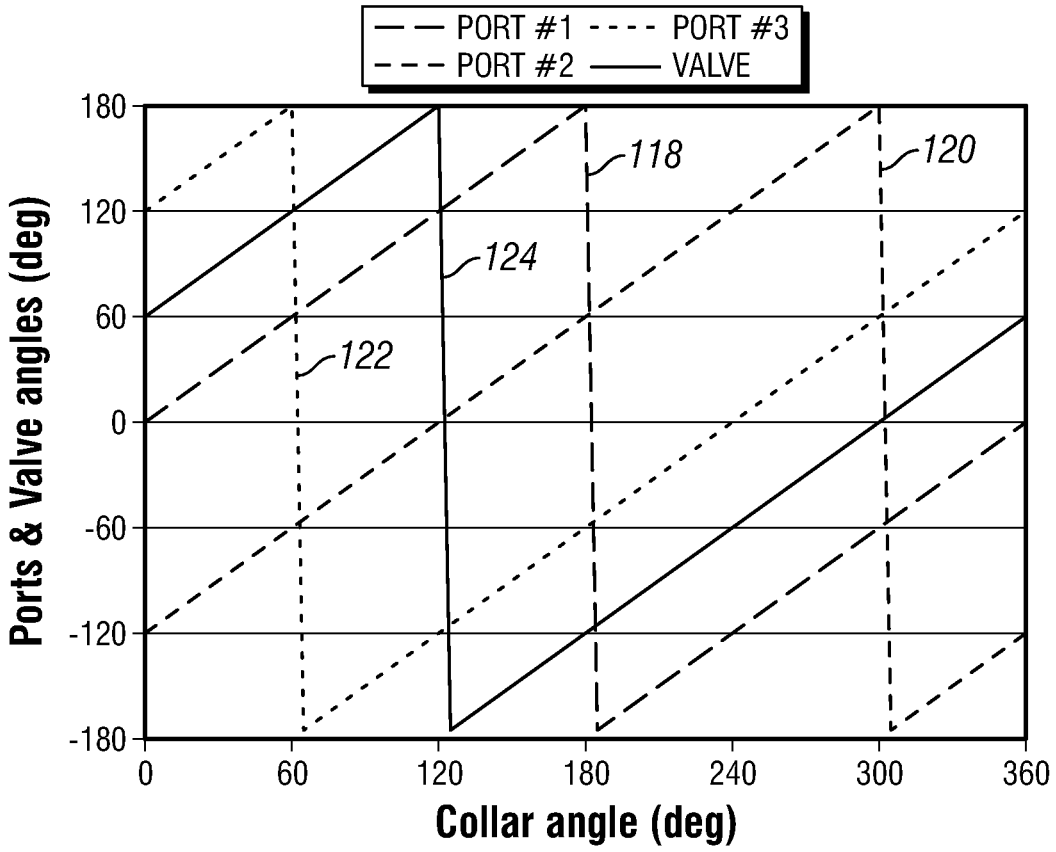
FIG. 21 is a graphical representation showing the drill collar angle versus the angular position of the rotational valve opening and the flow ports during drilling of a straight section of wellbore when no side force is generated, according to an embodiment of the present invention.
Figure 22A:
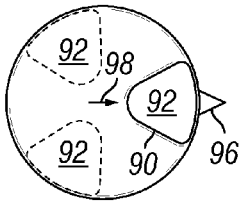
FIG. 22 is a schematic illustration of the corresponding positions of the rotational valve opening and the corresponding flow ports in the example of FIG. 16 during operation of the rotary steerable system when side force is generated between the −55° and +55° angular positions of the drill collar, according to an embodiment of the present invention.
Figure 22B:
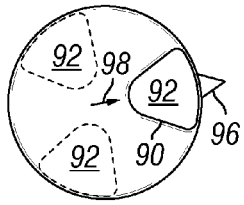
Figure 22C:
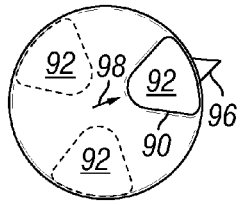
Figure 22D:
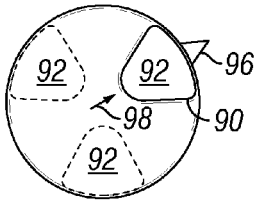
Figure 22E:
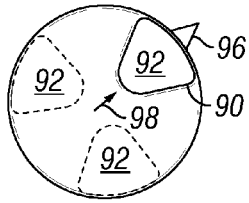
Figure 22F:
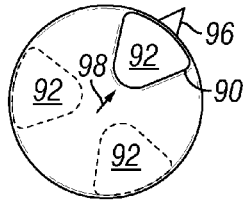
Figure 22G:
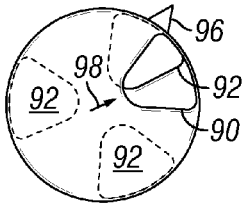
Figure 22H:
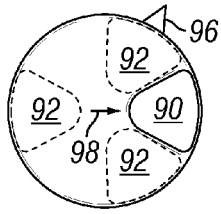
Figure 22I:
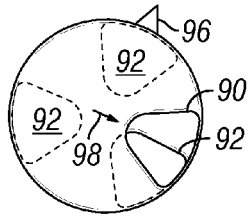
Figure 22J:
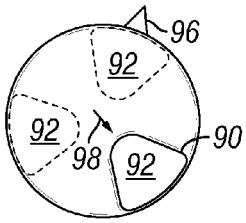
Figure 22K:
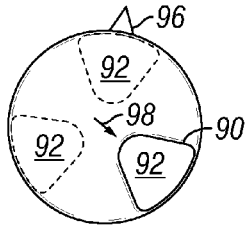
Figure 22L:
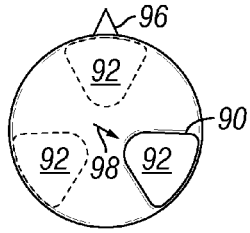
Figure 22M:
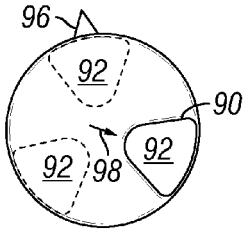
Figure 22N:
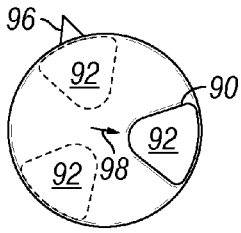
Figure 22O:
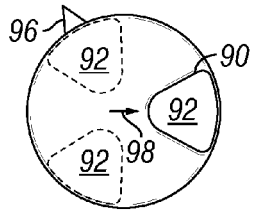

To maintain the valve opening 90 of spider valve 66 in the off position, the spider valve angle is continuously measured by the shaft encoder/sensor 74. The drill collar angle is determined and fixed by the rigid mounting of the pressure housing 86 to the drill collar 34 via, for example, mounting structures 88. In the graphical illustration of FIG. 21, a plot is provided of the angular positions of the first (1), second (2), and third (3) ports 92 as represented by graph lines 118, 120, and 122, respectively. The angular positions of ports 92 are plotted against the angular position of the spider valve 66, e.g. versus the angular position of valve opening 90 as represented by graph line 124, for a full rotation of the drill collar 34. In this application, the spider valve 66 rotates at the same RPM as the drill collar 34, and the valve opening 90 remains in a position between ports 92 during the full 360° of rotation.

If a side force is to be applied to the rotary steerable system 28, the spider valve 66 is controlled via motor 72 and controller 76, e.g. a microprocessor, to open a port 92 in a manner which allows activating fluid 50 to activate a corresponding steering pad 30 while the other two ports 92 are closed. In the example illustrated in FIG. 22, the side force is applied primarily in a positive x-direction to deflect the rotary steerable system 28 toward the negative x-direction. FIG. 22 illustrates a sequence of drill collar 34 and spider valve 66 rotational movements that produce a relatively large side force. In this example, the angular positions of the drill collar 34 range from 0° to 120° while the angular positions of the spider valve 66 range between −50° and +50°.

As illustrated, the spider valve angle is the same as the drill collar angle from 0° to 50°. During this portion of rotation, the valve opening 90 is maintained in alignment with the first (1) port 92 to enable flow to the corresponding steering pad 30. Once the 50° angular position is reached, the spider valve 66 is rotated rapidly in the clockwise direction so the first (1) port 92 is closed and the second (2) port 92 is opened to actuating fluid 50 under pressure. As the drill collar 34 continues to rotate from 60° to 120°, the spider valve 66 is rotated from −50° to 0°. During rotation of the spider valve 66 from −50° to 0°, the valve opening 90 is maintained in alignment with the second (2) port 92 to enable flow to the corresponding second steering pad 30. When the drill collar angle is between, for example, 55° and 65°, the port 92 is partially open so the corresponding steering pad 30 is activated. Consequently, forces are delivered over drill collar angles from approximately −55° to +55°. A similar sequence of relative spider valve movement occurs for the second (2) port 92 for drill collar angles from 120° to 240° and for the third (3) port 92 for drill collar angles from 240° to 360°.

Figure 23:
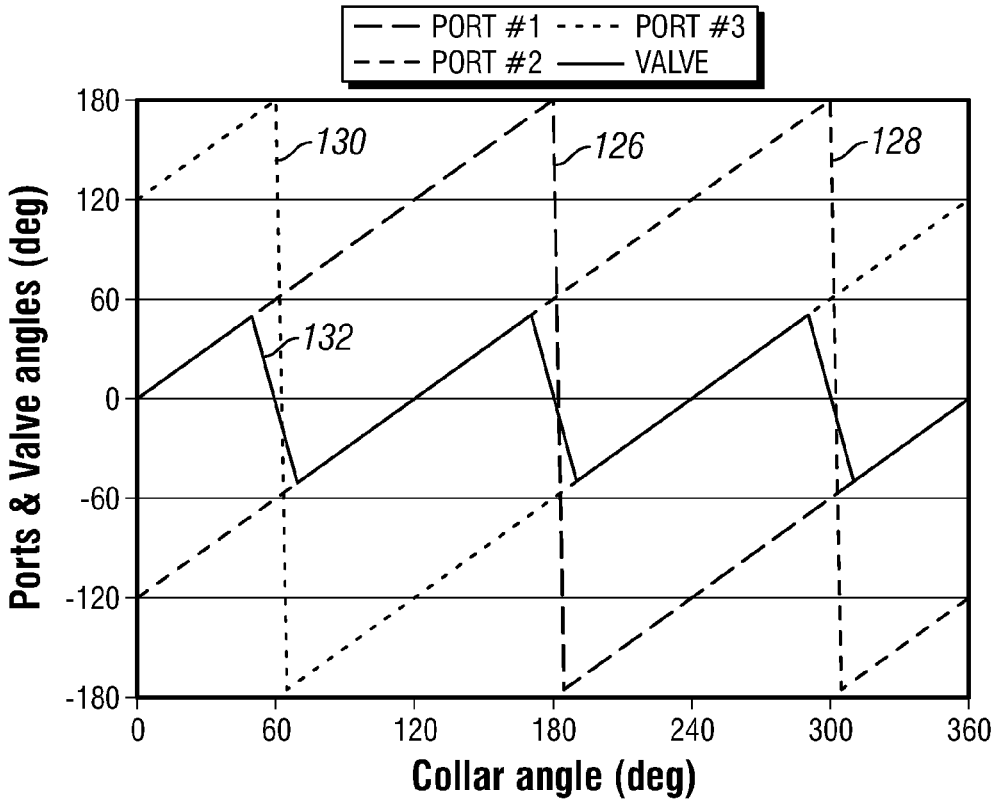
FIG. 23 is a graphical representation showing the drill collar angle versus the angular position of the rotational valve opening and the flow ports during production of side forces from −55° to +55°, according to an embodiment of the present invention.

In FIG. 23, the drill collar angle as represented by triangular marker 96 is plotted versus the angular position of first (1), second (2), and third (3) ports 92 (see graph lines 126, 128 and 130, respectively) and versus the angular position of the spider valve 66 (see graph line 132). The sequence depicted in FIGS. 22 and 23 represents rotation of the spider valve 66 over an angular range of 100° (from +50° to −50°) while the drill collar 34 rotates 20° (from +50° to +70°). Accordingly, the spider valve 66 is able to rotate at 5 times the RPM of the drill collar 34 based on input from motor 72. By way of example, if the maximum RPM of the drill string 24 and thus of the drill collar 34 is 180 RPM, motor 72 is selected with a capability of rotating the spider valve at 900 RPM or 15 Hz. However, these rotational speeds are merely examples and the actual rotational speeds of the drill string, drill collar and spider valve may be selected according to the parameters of a specific application.

Figure 24:
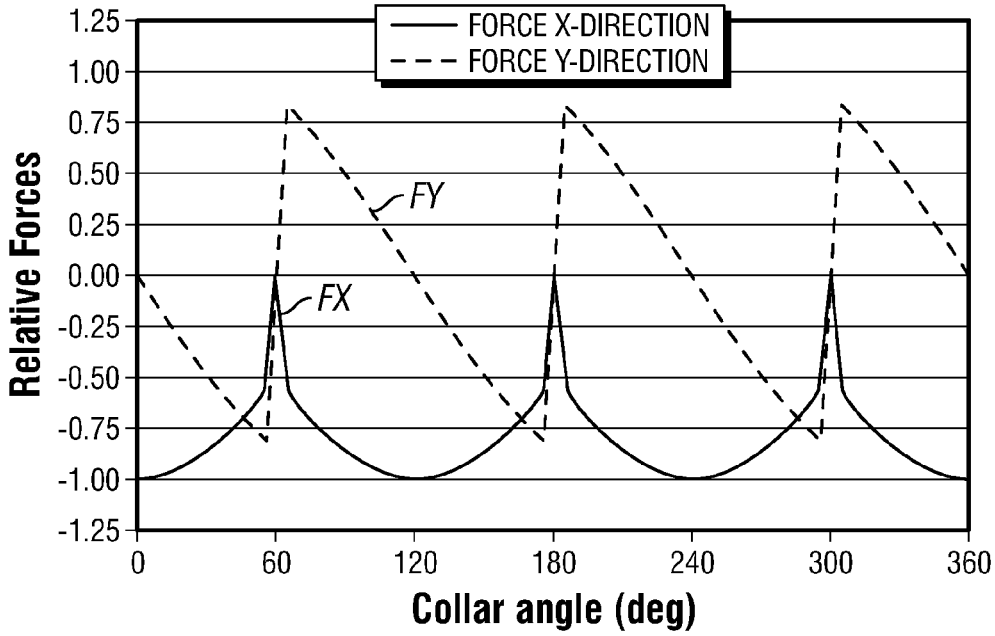
FIG. 24 is a graphical representation showing the drill collar angle versus the relative forces generated in the x and y directions, according to an embodiment of the present invention.
Figure 25A:
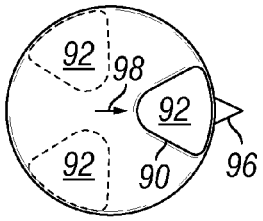
FIG. 25 is a schematic illustration of the corresponding positions of the rotational valve opening and the corresponding flow ports in the example of FIG. 16 during operation of the rotary steerable system when side force is generated between the −35° and +35° angular positions of the drill collar, according to an embodiment of the present invention.
Figure 25B:
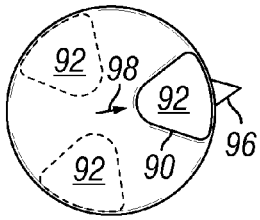
Figure 25C:
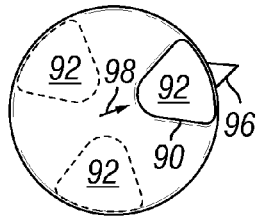
Figure 25D:
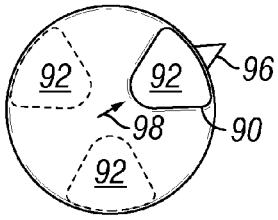
Figure 25E:
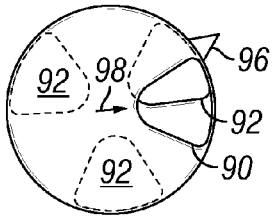
Figure 25F:
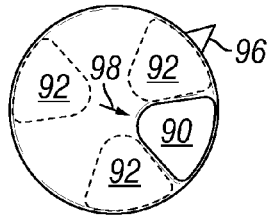
Figure 25G:
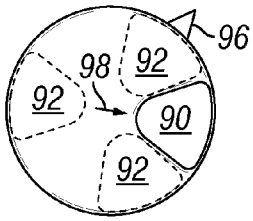
Figure 25H:
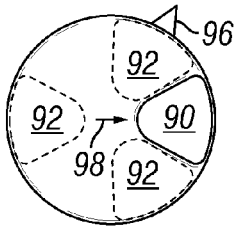
Figure 25I:
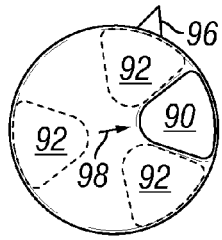
Figure 25J:
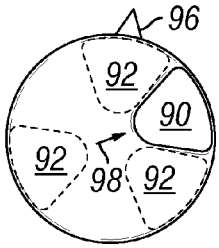
Figure 25K:
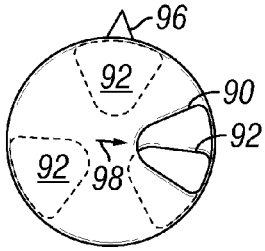
Figure 25L:
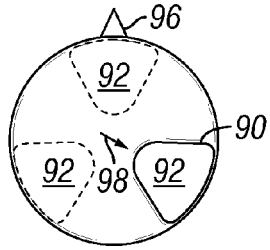
Figure 25M:
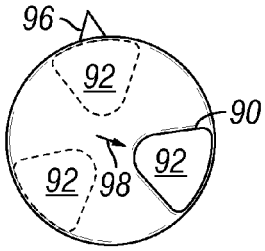
Figure 25N:
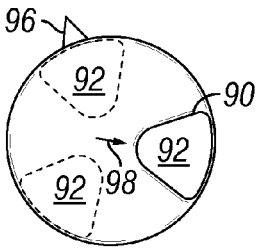
Figure 25O:
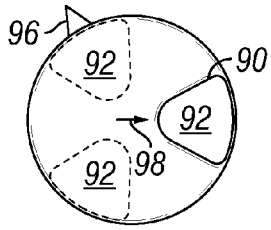

Because only one port 92 is open at any instant, the forces acting on the rotary steerable system 28 can be calculated from the angle of the spider valve 66, provided a port 92 is open. The x and y components of the force are plotted versus the angular position of the drill collar 34 in the graph of FIG. 24. As discussed above, the forces on the assembly in the x and y directions are given by $Fx=-F\cos(\theta)$ and $Fx=-F\sin(\theta)$ where $\theta$ is the angle of the drill collar modulo 120° and where F is the force the steering pad 30 exerts against the borehole wall. The force in the x-direction is never positive ($Fx \leqq 0$) while the force in the y-direction is equally applied in the positive and negative directions. As illustrated, large excursions occur in the Fy component but the average force in the y-direction is zero. As discussed above, the drill bit deflection is proportional to the force component average over a rotation of the drill collar:

$$\langle Fx\rangle = \frac{1}{2\pi}\int_0^{2\pi} Fx(\theta)d\theta \text{ and } \langle Fy\rangle = \frac{1}{2\pi}\int_0^{2\pi} Fy(\theta)d\theta.$$

As noted above, <Fy> equals zero and therefore no net deflection occurs in the y-direction.

To reduce the dogleg severity during drilling of wellbore 26, the spider valve 26 may be controlled to alternate between drilling modes such as those described above. For example, all steering pads 30 may be collapsed during one rotation of drill collar 34 as illustrated in FIGS. 8 and 9. However, the selective activation of single steering pads 30 may be employed to drill at an angle (dogleg) as illustrated in FIG. 22 during the next rotation of drill collar 34. By varying the number of rotations for the two modes, a range of doglegs or drilling angles can be achieved from a deviation angle of zero to a maximum possible deviation angle.

Another method for controlling the dogleg severity is to selectively activate steering pads 30 during a single rotation of the drill collar 34. For example, the first and second steering pads 30 may be activated for drill collar angles from 0° to 120° to create a side force. For the remainder of the drill collar rotation, i.e. from 120° to 360°, none of the steering pads 30 is actuated. Consequently, deflection occurs during only a portion of the drill collar rotation. Increased dogleg severity can be achieved by activating the steering pads 30 over, for example, drill collar angles from 0° to 240° but not from 240° to 360°. Furthermore, this method and the method described in the preceding paragraph can be combined. For example, drill collar rotations where no steering pads 30 are activated can be alternated with drill collar rotations during which the pads are activated for a subset of the time of each drill collar rotation.

Use of the electric motor 72 to control spider valve 66 also facilitates another method for varying the deflection force acting on the rotary steerable system 28 and involves further restricting the range of drill collar angles over which single steering pads 30 are activated. For example, movement of the spider valve 66 may be programmed to create a side force applied to the rotary steerable system 28 by opening a port 92 over a restricted angular range while the other ports 92 are closed. In the example illustrated in FIG. 25, the side force is applied primarily in a positive x-direction to deflect the rotary steerable system 28 toward the negative x-direction. FIG. 25 illustrates a sequence of drill collar 34 and spider valve 66 rotational movements that produce a smaller side force. In this example, the angular positions of the drill collar 34 range from 0° to 120° while the spider valve 66 activates steering pads 30 for drill collar angles from −35° to +35°. The reduced period during which the force is applied in the x-direction results in a lower dogleg severity.

As illustrated, the spider valve angle is the same as the drill collar angle from 0° to 30°. During this portion of rotation, the valve opening 90 is maintained in alignment with the first (1) port 92 to enable flow to the corresponding steering pad 30. Once the 30° angular position is reached, the spider valve 66 begins to rotate clockwise such that as the drill collar angle reaches 40°, the spider valve angle is at −20°. For drill collar angles from 40° to 80°, the spider valve 66 again rotates counterclockwise with the drill collar 34 while positioned between the first (1) and second (2) port 92. Hence no net side force is applied to the drilling assembly 28 for drill collar angles from 40° to 80°. Subsequently, the second steering pad 30 is activated during drill collar angles from 85° to 120° as the spider valve 66 again rotates with the drill collar 34.

Figure 26:
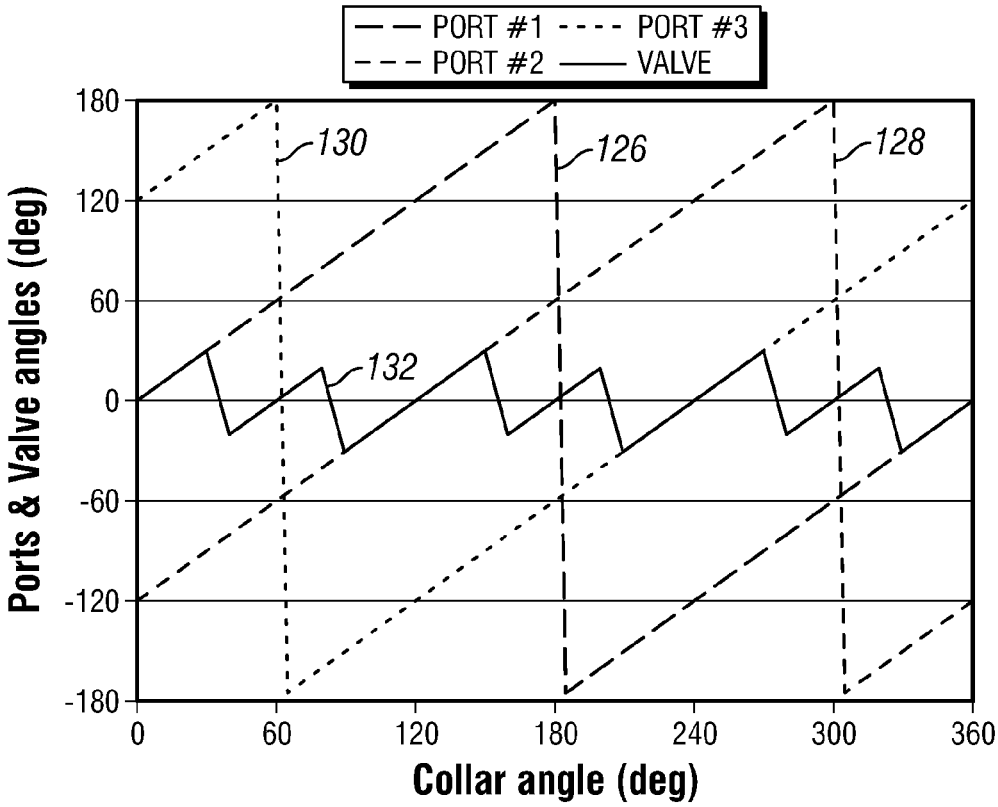
FIG. 26 is a graphical representation showing the drill collar angle versus the angular position of the rotational valve opening and the flow ports during production of side forces from −35° to +35°, according to an embodiment of the present invention.

The angular orientation of the spider valve 66 follows a sawtooth pattern, as illustrated in FIG. 26. Except during transition, the spider valve 66 always moves at the same RPM as the drill collar 34. In FIG. 26, the drill collar angle, as represented by triangular marker 96, is plotted versus the angular position of first (1), second (2), and third (3) ports 92 (see graph lines 126, 128, and 130, respectively) and versus the angular position of the spider valve 66 (see graph line 132). The sequence depicted in FIGS. 25 and 26 shows that the spider valve 66 follows a pattern in a relatively narrow range.

Figure 27:
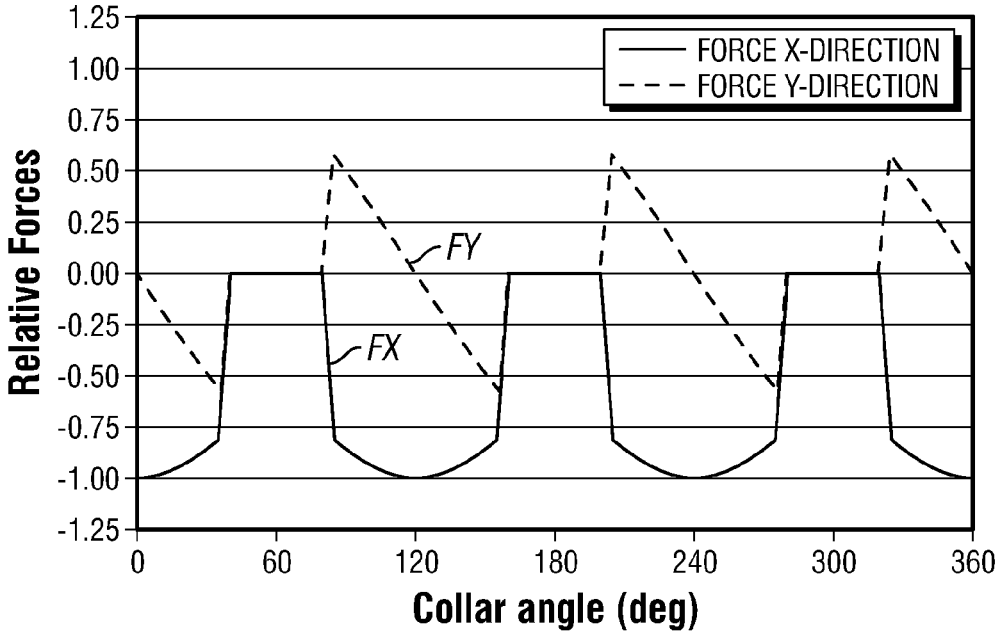
FIG. 27 is a graphical representation showing the drill collar angle versus the relative forces generated in the x and y directions, according to an embodiment of the present invention.
Figure 28A:
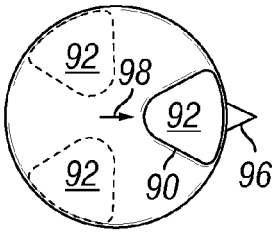
FIG. 28 is a schematic illustration of the corresponding positions of the rotational valve opening and the corresponding flow ports in the example of FIG. 16 during operation of the rotary steerable system when side force is generated between the −15° and +15° angular positions of the drill collar, according to an embodiment of the present invention.
Figure 28B:
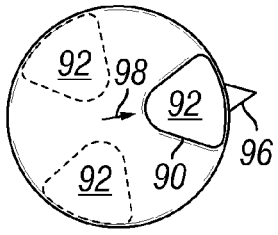
Figure 28C:
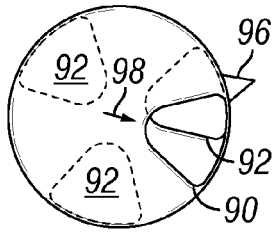
Figure 28D:
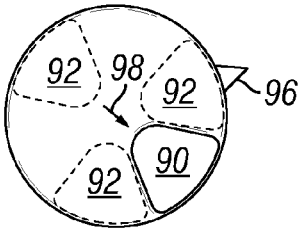
Figure 28E:
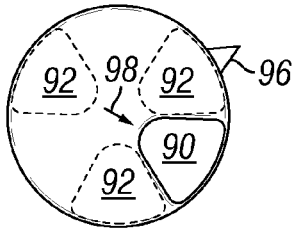
Figure 28F:
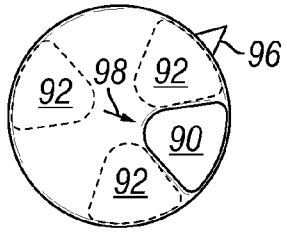
Figure 28G:
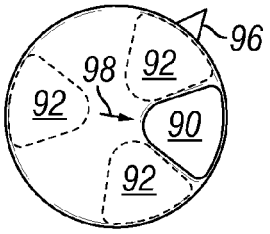
Figure 28H:
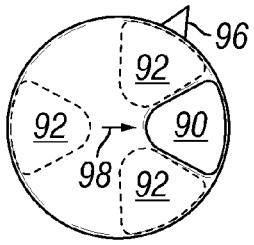
Figure 28I:
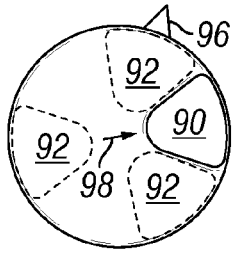
Figure 28J:
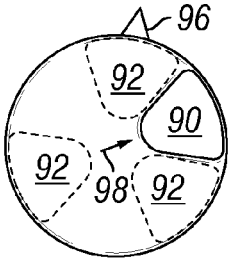
Figure 28K:
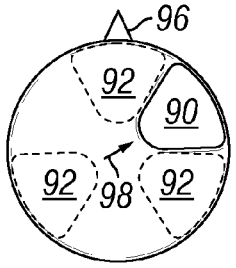
Figure 28L:
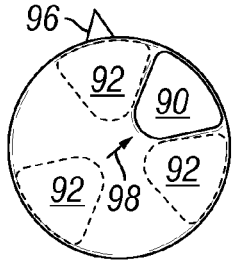
Figure 28M:
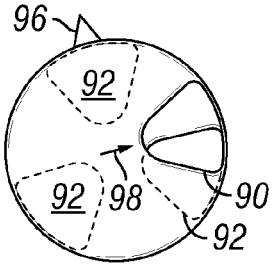
Figure 28N:
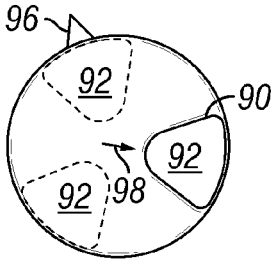
Figure 28O:
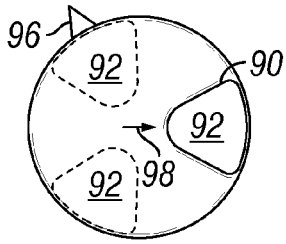

The force components in the x and y directions are illustrated in FIG. 27. As illustrated, three angular ranges occur in each drill collar rotation in which no forces are applied. The maximum force in the y-direction has been significantly reduced, and the force in the x-direction also is reduced, but by a smaller amount. Thus, the application of force is more efficient in deflecting the drill bit in the x-direction because less energy has been expended in the y-direction.

Electric motor 72 and micro-controller 76 may be employed to vary the deflection force acting on the rotary steerable system 28 according to a variety of paradigms. For example, movement of the spider valve 66 may be programmed to create a side force applied to the rotary steerable system 28 by opening a port 92 over a more restricted angular range while the other ports 92 are closed. In the example illustrated in FIG. 28, the side force is applied primarily in a positive x-direction to deflect the rotary steerable system 28 toward the negative x-direction. FIG. 28 illustrates a sequence of drill collar 34 and spider valve 66 rotational movements that produce a smaller side force. In this example, the angular positions of the drill collar 34 range from 0° to 120° while the spider valve 66 activates steering pads 30 for drill collar angles from −15° to +15°. The reduced period during which the force is applied in the x-direction results in a lower dogleg severity.

As illustrated, the spider valve angle is the same as the drill collar angle from 0° to 10°. During this portion of rotation, the valve opening 90 is maintained in alignment with the first (1) port 92 to enable flow to the corresponding steering pad 30. Once the 10° angular position is reached, the spider valve 66 is rotated clockwise such that as the drill collar angle reaches 20°, the spider valve angle is at −40°. For drill collar angles from 20° to 100°, the spider valve 66 again rotates counter-clockwise with the drill collar 34 while positioned between the first (1) and second (2) port 92. Hence no net side force is applied to the drilling assembly 28 for drill collar angles from 20° to 100°. Subsequently, the second steering pad 30 is activated during drill collar angles from 105° to 120° as the spider valve 66 again rotates with the drill collar 34.

Figure 29:
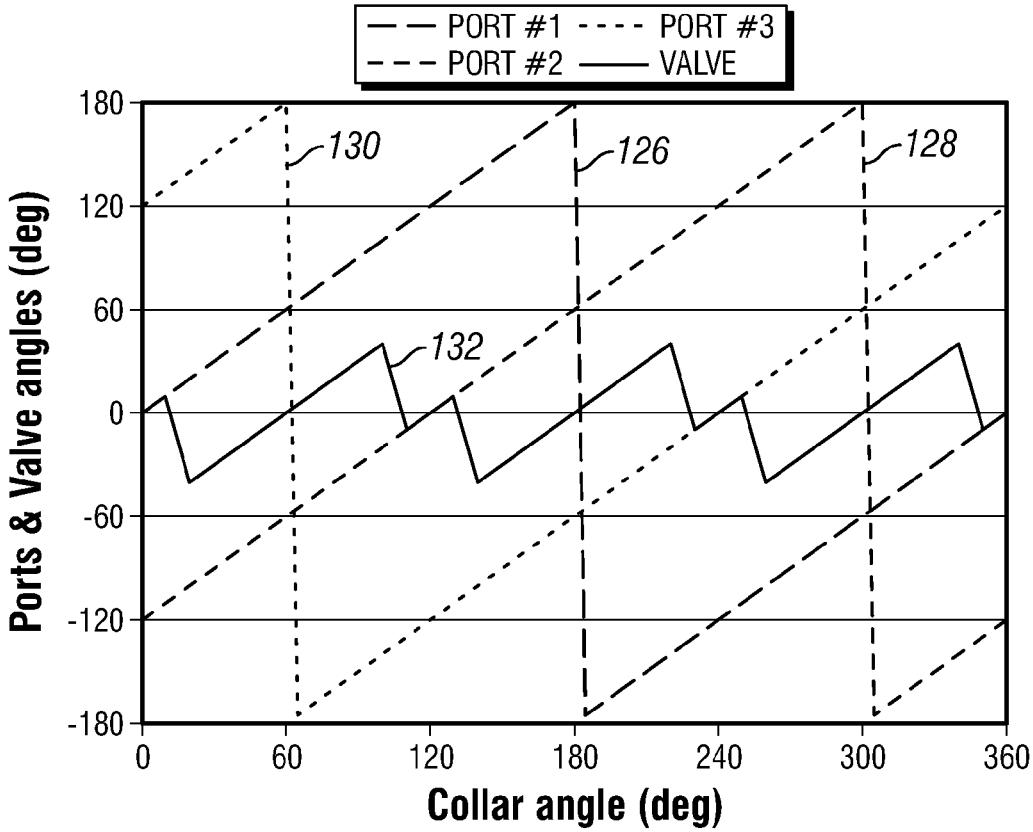
FIG. 29 is a graphical representation showing the drill collar angle versus the angular position of the rotational valve opening and the flow ports during production of side forces from −15° to +15°, according to an embodiment of the present invention.

The angular orientation of the spider valve 66 in this example follows a pattern as illustrated in FIG. 29. Except during transition, the spider valve 66 always moves at the same RPM as the drill collar 34. In FIG. 29, the drill collar angle, as represented by triangular marker 96, is plotted versus the angular position of first (1), second (2), and third (3) ports 92 (see graph lines 126, 128, and 130, respectively) and versus the angular position of the spider valve 66 (see graph line 132). The sequence depicted in FIGS. 28 and 29 shows that the spider valve 66 again follows a pattern in a narrow range.

Figure 30:
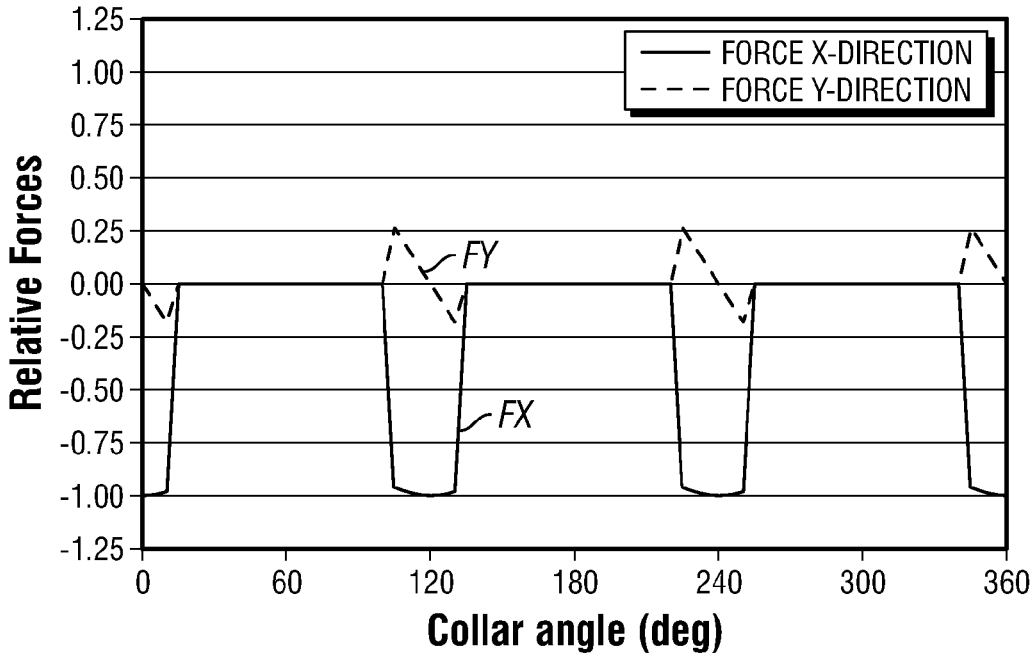
FIG. 30 is a graphical representation showing the drill collar angle versus the relative forces generated in the x and y directions, according to an embodiment of the present invention.

The force components in the x and y directions are illustrated in FIG. 30. As illustrated, three angular ranges occur in each drill collar rotation in which no forces are applied. The maximum force in the y-direction has been significantly reduced, and the force in the x-direction also is reduced, but by a smaller amount. Thus, the application of force is more efficient in deflecting the drill bit in the x-direction because less energy has been expended in the y-direction. In this example, duration of the force is substantially shorter than in previous examples.

Figure 31:
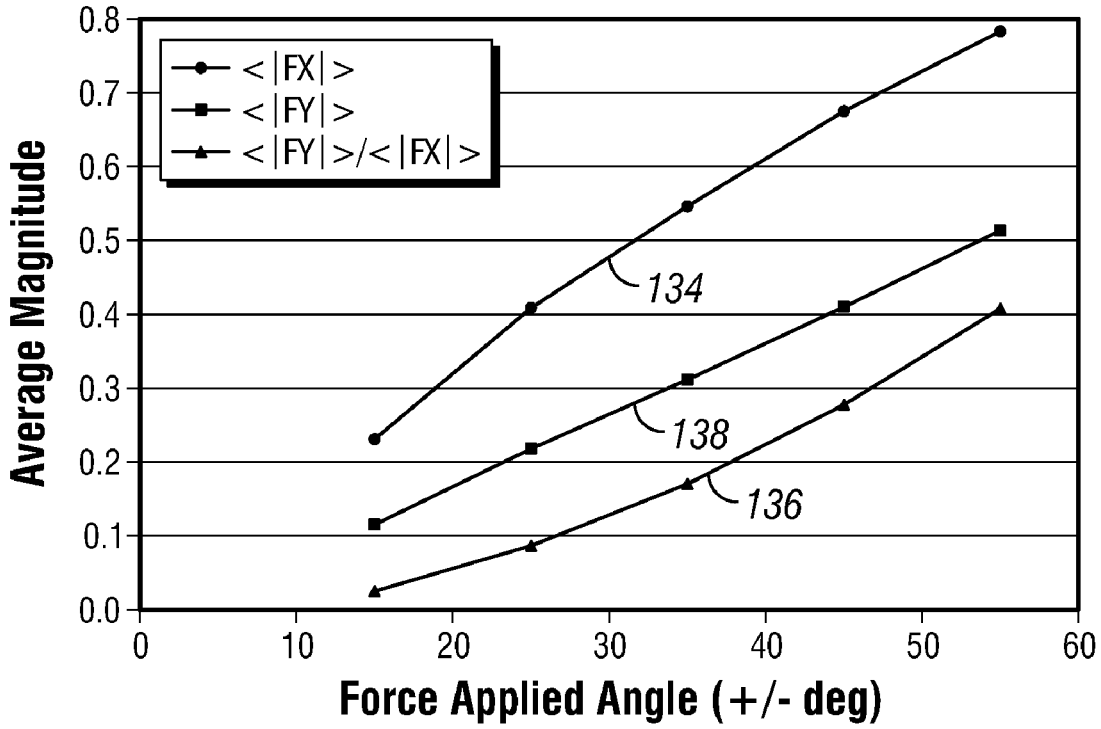
FIG. 31 is a graphical representation showing average forces applied versus activation angles, according to an embodiment of the present invention.

An example of the average forces applied versus the activation angles is illustrated in FIG. 31. Because the sign of Fx is always negative, the magnitude of the drill bit deflection in the x-direction is given by:

$$\langle Fx \rangle = \frac{1}{2\pi}\int_0^{2\pi} Fx(\theta)d\theta.$$

This quantity is plotted in FIG. 31 versus the range of angles over which the forces applied and labeled by graph line 134. The duration of the force Fx(θ) is related to the angle of the spider valve 66. The maximum value for <|Fx|> is 0.78 for the range of angles from −55° to +55° and the minimum value for <|Fx|> is 0.23 for the range of angles from −15° to +15° in these examples. It should be noted the radial force has a unity magnitude, i.e. F=1. The content illustrated graphically in FIG. 31 can be used in an algorithm to relate dogleg severity to the range of angles over which side forces are applied. This data can be used in a look-up table are simply calculated from a polynomial.

Even though there is no net impulse in the y-direction and the steering pads 30 do not exert forces in the positive or negative y-directions, the steering pads may suffer wear and abrasion due to contact with the wellbore wall. The wear resulting from forces in the y-direction is proportional to:

$$\langle Fy \rangle = \frac{1}{2\pi}\int_0^{2\pi} Fy(\theta)d\theta$$

which is non-zero. Referring again to FIG. 31, both <|Fy|> and the ratio of <|Fy|>/<|Fx|> are plotted as graph lines 136 and 138, respectively. A small value for the ratio indicates a more efficient operation, i.e. less force is wasted in the y-direction which results in less steering pad wear.

A variation of the methods described above enables maintenance of steering control when one of the steering pads 30 is disabled. If, for example, a gasket associated with the first steering pad 30 is damaged so the steering pad can no longer exert a force on the formation, the failure of the individual steering pad 30 can be compensated by increasing the duration of the force exerted by the other two steering pads 30. The flexible control over rotational valve 66 also enables adjustments for a variety of application and environmental factors. For example, some rotary steerable systems 28 may utilize a fixed stabilizer near the top end of the tool. In this example, the bit may tend to drop angle in a deviated or horizontal well when all of the steering pads 30 are collapsed. However, this tendency is easily compensated by applying a small impulse in the positive vertical direction to overcome the tendency for the drill bit to drop angle.

The well drilling system 20 and rotary steerable assembly may be constructed according to a variety of configurations with many types of components. The actual construction of the drilling system and the components selected depend on the type of wellbore desired and the size and shape of the reservoir accessed by the wellbore. For example, numerous types of drill collars, sensing systems, and other components may be incorporated into the drill string. The steering system may utilize a single steering pad 30 or a plurality of steering pads. If a plurality of steering pads is employed, the steering pads may be turned "off" by activating all of the steering pads simultaneously or, alternatively, by deactivating all of the steering pads simultaneously.

Furthermore, the rotational valve system may have a variety of sizes and configurations with three, four, five, or other numbers of valve openings arranged in a desired angular patterns to correspond with actuating fluid ports of the drill collar. The motor employed to operate the rotational valve may be an electric motor of a variety of sizes, configurations and power ratings depending on the parameters of a given application. Furthermore, the control system may comprise a microprocessor or other type of micro-controller which is programmable to operate the rotational valve according to a variety of paradigms for drilling straight and/or deviated sections of wellbore. Additionally, the rotational valve, motor, and control system may be part of various types of drilling assemblies, including point-the-bit assemblies, push-the-bit assemblies, and hybrid assemblies.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a wellbore, comprising:

a rotary steerable system having:

a drill collar rotatably mounted in the rotary steerable system for rotation during drilling of the wellbore;

a plurality of movable steering pads mounted to the drill collar, the plurality of movable steering pads being hydraulically actuated by a fluid directed through a plurality of ports corresponding with the plurality of movable steering pads, the plurality of ports comprising corresponding ports which are each hydraulically coupled with one of the movable steering pads and a collective port which is hydraulically coupled with all of the movable steering pads of the plurality of movable steering pads, the collective port being independent of the corresponding ports; and a spider valve positioned in the drill collar to control flow of the fluid to the plurality of ports for selectively actuating the plurality of movable steering pads.

2. The system as recited in claim 1, further comprising an electric motor coupled to the spider valve, the electric motor being controlled to rotate the spider valve in a manner which controls flow of fluid to desired ports of the plurality of ports.

3. The system as recited in claim 2, wherein the plurality of movable steering pads comprises three movable steering pads, and the plurality of ports comprises three corresponding ports and one collective port.

4. The system as recited in claim 2, wherein the rotary steerable system further comprises an encoder positioned to measure an angular position of the spider valve relative to the drill collar.

5. The system as recited in claim 4, wherein the rotary steerable system further comprises control electronics, the electric motor and the encoder being coupled to the control electronics.

6. The system as recited in claim 5, wherein the electric motor, encoder, and control electronics are located within a pressure housing within the drill collar.

7. The system as recited in claim 1, wherein the spider valve is rotated by the electric motor to direct the fluid through the plurality of ports in a manner which causes individual movable steering pads of the plurality of steering pads to extend while within a desired angular range of rotation of the drill collar.

8. The system as recited in claim 1, wherein the spider valve is rotated by the electric motor to direct the fluid through the collective port to cause drilling of a straight section of the wellbore.

9. The system as recited in claim 1, wherein the rotation of the spider valve is selectively changed to change the severity of a dogleg being formed during drilling of the wellbore.

10. A system for drilling a wellbore, comprising:

a rotary steerable system having:

a drill collar rotatably mounted for rotation during drilling of the wellbore;

at least one movable steering pad mounted to the drill collar, the at least one movable steering pad being hydraulically actuated periodically, as the drill collar is rotated, by a fluid directed through at least one port corresponding with the at least one movable steering pad, the at least one port being positioned in the drill collar to create at least one no flow region; and a spider valve rotatably positioned in the drill collar to control flow of the fluid to the at least one port for actuating the at least one movable steering pad, the spider valve comprising a valve opening which is: selectively rotated with respect to the drill collar into cooperation with a selected port of the at least one port to enable flow to a corresponding movable steering pad; or selectively rotated with respect to the drill collar to a no flow region of the at least one no flow region to prevent flow to all movable steering pads mounted to the drill collar.

11. The system as recited in claim 10, further comprising an electric motor coupled to the spider valve, the electric motor being controlled to rotate the spider valve in a manner which allows flow of fluid through a desired port of the at least one port or which prevents flow by maintaining the valve opening adjacent a no flow region.

12. The system as recited in claim 11, wherein the at least one movable steering pad comprises at least three movable steering pads, and the at least one port comprises at least three ports.

13. The system as recited in claim 11, wherein the rotary steerable system further comprises an encoder positioned to measure an angular position of the spider valve relative to the drill collar.

14. The system as recited in claim 13, wherein the rotary steerable system further comprises control electronics, the electric motor and the encoder being coupled to the control electronics.

15. The system as recited in claim 14, wherein the electric motor, encoder, and control electronics are located within a pressure housing within the drill collar.

16. The system as recited in claim 12, wherein the spider valve is rotated by the electric motor to direct the fluid through the ports in a manner which causes individual movable steering pads to extend while within a desired angular range of rotation of the drill collar.

17. The system as recited in claim 10, wherein the spider valve is rotated by the electric motor to cause drilling of a straight section of the wellbore by maintaining the valve opening in a no flow region.

18. The system as recited in claim 10, wherein the rotation of the spider valve is selectively changed to change the severity of a dogleg being formed during drilling of the wellbore.

19. A method of forming a wellbore, comprising:

mounting a spider valve in a drill collar to control flow of an actuating fluid to a plurality of movable steering pads via ports which rotate with the drill collar during drilling;

selectively controlling the spider valve to provide fluid flow to individual ports or to provide similar fluid flow input to all of the ports simultaneously; and coupling a motor to the spider valve to rotate the spider valve between ports at different rates of rotation in a manner which controls flow of the actuating fluid to cause drilling of the wellbore along a deviated path or along a straight path.

20. The method as recited in claim 19, further comprising drilling the deviated path by directing the fluid through the plurality of ports in a manner which causes individual movable steering pads of the plurality of steering pads to extend while within a desired angular range of rotation of the drill collar.

* * * * *